US010118420B2

(12) United States Patent
Arisawa

(10) Patent No.: US 10,118,420 B2
(45) Date of Patent: Nov. 6, 2018

(54) CONVEYANCE APPARATUS, CONTROL METHOD, AND NON-TRANSITORY COMPUTER-READABLE MEDIUM STORING A PROGRAM FOR CONTROLLING AN INTERVAL BETWEEN A PRINT MEDIUM TO BE USED FOR SINGLE-SIDED PRINTING AND A PRINT MEDIUM TO BE USED FOR DOUBLE-SIDED PRINTING

(71) Applicant: CANON KABUSHIKI KAISHA, Tokyo (JP)

(72) Inventor: Yuuki Arisawa, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/662,679

(22) Filed: Jul. 28, 2017

(65) Prior Publication Data

US 2018/0043707 A1 Feb. 15, 2018

(30) Foreign Application Priority Data

Aug. 10, 2016 (JP) ..... 2016-158126

(51) Int. Cl.
*B41J 3/60* (2006.01)
*B41J 13/08* (2006.01)
*B41J 13/00* (2006.01)

(52) U.S. Cl.
CPC ..... *B41J 13/0027* (2013.01); *B41J 13/0018* (2013.01); *B41J 13/0036* (2013.01); *B41J 13/08* (2013.01)

(58) Field of Classification Search
CPC ..... B41J 3/60; B41J 13/0009; B41J 13/0018; B41J 13/0027; B41J 13/0036; B41J 13/08
See application file for complete search history.

(56) References Cited

U.S. PATENT DOCUMENTS

2006/0239699 A1* 10/2006 Heimbach ..... G03G 15/6564 399/16
2013/0256982 A1* 10/2013 Kawanago ..... G03G 15/234 271/225

(Continued)

FOREIGN PATENT DOCUMENTS

JP 2014-021268 A 2/2014

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A conveyance apparatus performs single-sided printing, and double-sided printing, using a re-conveyance unit. If a first print medium is a print medium to be used for single-sided printing and a re-conveyed print medium is located within a predetermined distance from a region where the first print medium is located, an interval between the region where the first print medium is located and a region where a second print medium is located is controlled to be a first interval. If the first print medium is a print medium to be used for single-sided printing and a re-conveyed print medium is not located within the predetermined distance from the region where the first print medium is located, the interval between the region where the first print medium is located and the region where the second print medium is located is controlled to be a second interval shorter than the first interval.

12 Claims, 33 Drawing Sheets

(56) References Cited

U.S. PATENT DOCUMENTS

| | | | | |
|---|---|---|---|---|
| 2014/0023417 | A1 | 1/2014 | Miyake | |
| 2014/0098154 | A1 * | 4/2014 | Fujimoto | B41J 3/60 347/16 |

* cited by examiner

FIG. 7A 701 702 703

| FEED NUMBER | PAGE NUMBER | TYPE |
|---|---|---|
| | | |

FIG. 7B 701 702 703

| FEED NUMBER | PAGE NUMBER | TYPE |
|---|---|---|
| 1 | 1 | DOUBLE-SIDED |
| 2 | | |

FIG. 7C 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |

FIG. 7D 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |

FIG. 7E 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |

FIG. 7F 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |

FIG. 8A 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |

FIG. 8B 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |

FIG. 8C 701 702 703

| FEED NUMBER | PAGE NUMBER | TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |

FIG. 8D

| 701 FEED NUMBER | 702 PAGE NUMBER | 703 TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |
| 17 | 10 | SINGLE-SIDED |
| 18 | 11 | SINGLE-SIDED |

FIG. 8E

| 701 FEED NUMBER | 702 PAGE NUMBER | 703 TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |
| 17 | 10 | SINGLE-SIDED |
| 18 | 11 | SINGLE-SIDED |
| 19 | 12 | SINGLE-SIDED |
| 20 | 13 | SINGLE-SIDED |

FIG. 8F

| 701 FEED NUMBER | 702 PAGE NUMBER | 703 TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |
| 17 | 10 | SINGLE-SIDED |
| 18 | 11 | SINGLE-SIDED |
| 19 | 12 | SINGLE-SIDED |
| 20 | 13 | SINGLE-SIDED |
| 21 | | |
| 22 | | |

FIG. 9A

| 701 FEED NUMBER | 702 PAGE NUMBER | 703 TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |
| 17 | 10 | SINGLE-SIDED |
| 18 | 11 | SINGLE-SIDED |
| 19 | 12 | SINGLE-SIDED |
| 20 | 13 | SINGLE-SIDED |
| 21 | | |
| 22 | | |
| 23 | | |
| 24 | | |

FIG. 9B

| 701 FEED NUMBER | 702 PAGE NUMBER | 703 TYPE |
|---|---|---|
| 1 | 1 | DOUBLE-SIDED |
| 2 | | |
| 3 | 2 | DOUBLE-SIDED |
| 4 | | |
| 5 | 3 | DOUBLE-SIDED |
| 6 | | |
| 7 | 4 | DOUBLE-SIDED |
| 8 | | |
| 9 | 5 | DOUBLE-SIDED |
| 10 | | |
| 11 | 6 | SINGLE-SIDED |
| 12 | | |
| 13 | 7 | SINGLE-SIDED |
| 14 | | |
| 15 | 8 | SINGLE-SIDED |
| 16 | 9 | SINGLE-SIDED |
| 17 | 10 | SINGLE-SIDED |
| 18 | 11 | SINGLE-SIDED |
| 19 | 12 | SINGLE-SIDED |
| 20 | 13 | SINGLE-SIDED |
| 21 | | |
| 22 | | |
| 23 | | |
| 24 | | |
| 25 | | |
| 26 | | |

FIG. 10

1001 1002

| PAGE NUMBER | TYPE |
|---|---|
| 1 | DOUBLE-SIDED |
| 2 | DOUBLE-SIDED |
| 3 | DOUBLE-SIDED |
| 4 | DOUBLE-SIDED |
| 5 | DOUBLE-SIDED |
| 6 | SINGLE-SIDED |
| 7 | SINGLE-SIDED |
| 8 | SINGLE-SIDED |
| 9 | SINGLE-SIDED |
| 10 | SINGLE-SIDED |
| 11 | SINGLE-SIDED |
| 12 | SINGLE-SIDED |
| 13 | SINGLE-SIDED |

FIG. 15A 1501 1502 1503

| FEED NUMBER | PAGE NUMBER | TYPE |
|---|---|---|
| | | |

FIG. 15B 1501 1502 1503

| FEED NUMBER | PAGE NUMBER | TYPE |
|---|---|---|
| 1 | 1 | SINGLE-SIDED |
| 2 | 2 | SINGLE-SIDED |

FIG. 15C 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |

FIG. 15D 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |

FIG. 15E 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |

FIG. 15F 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |

FIG. 16A 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |

FIG. 16B 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |

FIG. 16C 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |
| 15 | 13 | DOUBLE-SIDED |
| 16 | | |

FIG. 16D 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |
| 15 | 13 | DOUBLE-SIDED |
| 16 | | |
| 17 | | |
| 18 | | |

FIG. 16E 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |
| 15 | 13 | DOUBLE-SIDED |
| 16 | | |
| 17 | | |
| 18 | | |
| 19 | | |
| 20 | | |

FIG. 16F 1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |
| 15 | 13 | DOUBLE-SIDED |
| 16 | | |
| 17 | | |
| 18 | | |
| 19 | | |
| 20 | | |
| 21 | | |
| 22 | | |

FIG. 17

1501 1502 1503

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 5 | SINGLE-SIDED |
| 6 | 6 | SINGLE-SIDED |
| 7 | 9 | DOUBLE-SIDED |
| 8 | 7 | SINGLE-SIDED |
| 9 | 10 | DOUBLE-SIDED |
| 10 | 8 | SINGLE-SIDED |
| 11 | 11 | DOUBLE-SIDED |
| 12 | | |
| 13 | 12 | DOUBLE-SIDED |
| 14 | | |
| 15 | 13 | DOUBLE-SIDED |
| 16 | | |
| 17 | | |
| 18 | | |
| 19 | | |
| 20 | | |
| 21 | | |
| 22 | | |
| 23 | | |
| 24 | | |

FIG. 18

1801 1802

| PAGE NUMBER | TYPE |
|---|---|
| 1 | SINGLE-SIDED |
| 2 | SINGLE-SIDED |
| 3 | SINGLE-SIDED |
| 4 | SINGLE-SIDED |
| 5 | SINGLE-SIDED |
| 6 | SINGLE-SIDED |
| 7 | SINGLE-SIDED |
| 8 | SINGLE-SIDED |
| 9 | DOUBLE-SIDED |
| 10 | DOUBLE-SIDED |
| 11 | DOUBLE-SIDED |
| 12 | DOUBLE-SIDED |
| 13 | DOUBLE-SIDED |

FIG. 23A 2301 2302 2303

| FEED NUMBER | PAGE NUMBER | TYPE |
|---|---|---|
| | | |

FIG. 23B 2301 2302 2303

| FEED NUMBER | PAGE NUMBER | TYPE |
|---|---|---|
| 1 | 1 | SINGLE-SIDED |
| 2 | 2 | SINGLE-SIDED |

FIG. 23C 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |

FIG. 23D 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |

FIG. 23E 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |

FIG. 23F 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |

FIG. 24A 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |

FIG. 24B 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |

FIG. 24C 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |
| 15 | 7 | SINGLE-SIDED |
| 16 | | |

FIG. 24D 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |
| 15 | 7 | SINGLE-SIDED |
| 16 | | |
| 17 | 8 | SINGLE-SIDED |
| 18 | | |

FIG. 24E 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |
| 15 | 7 | SINGLE-SIDED |
| 16 | | |
| 17 | 8 | SINGLE-SIDED |
| 18 | | |
| 19 | | |
| 20 | | |

FIG. 24F 2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |
| 15 | 7 | SINGLE-SIDED |
| 16 | | |
| 17 | 8 | SINGLE-SIDED |
| 18 | | |
| 19 | | |
| 20 | | |
| 21 | | |
| 22 | | |

FIG. 25

2301 2302 2303

| FEED NUMBER | PAGE NUMBER | TYPE |
|---|---|---|
| 1 | 1 | SINGLE-SIDED |
| 2 | 2 | SINGLE-SIDED |
| 3 | 3 | SINGLE-SIDED |
| 4 | 4 | SINGLE-SIDED |
| 5 | 9 | DOUBLE-SIDED |
| 6 | 5 | SINGLE-SIDED |
| 7 | 10 | DOUBLE-SIDED |
| 8 | 6 | SINGLE-SIDED |
| 9 | 11 | DOUBLE-SIDED |
| 10 | | |
| 11 | 12 | DOUBLE-SIDED |
| 12 | | |
| 13 | 13 | DOUBLE-SIDED |
| 14 | | |
| 15 | 7 | SINGLE-SIDED |
| 16 | | |
| 17 | 8 | SINGLE-SIDED |
| 18 | | |
| 19 | | |
| 20 | | |
| 21 | | |
| 22 | | |
| 23 | | |
| 24 | | |

FIG. 26

2601 2602

| PAGE NUMBER | TYPE |
|---|---|
| 1 | SINGLE-SIDED |
| 2 | SINGLE-SIDED |
| 3 | SINGLE-SIDED |
| 4 | SINGLE-SIDED |
| 5 | SINGLE-SIDED |
| 6 | SINGLE-SIDED |
| 7 | SINGLE-SIDED |
| 8 | SINGLE-SIDED |
| 9 | DOUBLE-SIDED |
| 10 | DOUBLE-SIDED |
| 11 | DOUBLE-SIDED |
| 12 | DOUBLE-SIDED |
| 13 | DOUBLE-SIDED |

CONVEYANCE APPARATUS, CONTROL METHOD, AND NON-TRANSITORY COMPUTER-READABLE MEDIUM STORING A PROGRAM FOR CONTROLLING AN INTERVAL BETWEEN A PRINT MEDIUM TO BE USED FOR SINGLE-SIDED PRINTING AND A PRINT MEDIUM TO BE USED FOR DOUBLE-SIDED PRINTING

This application claims the benefit of Japanese Patent Application No. 2016-158126, filed Aug. 10, 2016, which is hereby incorporated by reference herein in its entirety.

BACKGROUND OF THE INVENTION

Field of the Invention

The present invention relates to a conveyance apparatus, a control method, and a non-transitory computer-readable medium storing a program.

Description of the Related Art

There are known image forming apparatuses used in the POD market and photo album market, such as a printer of an inkjet printing method and a printer of an electrophotographic method. Such image forming apparatuses can execute, for example, single-sided printing for printing ononly one surface of a sheet, and double-sided printing for printing on both surfaces of a sheet.

When executing double-sided printing, it is preferable to avoid a collision between a newly-fed sheet and a sheet re-conveyed for double-sided printing. To avoid a collision between sheets, an image forming apparatus that performs double-sided printing uses, for example, a method called an alternate circulation method (interleave method). Japanese Patent Laid-Open No. 2014-21268 describes an apparatus that forms an image by conveying a sheet by the alternate circulation method.

The alternate circulation method indicates a method of supplying sheets onto a conveyance path so that an interval between the sheets is equal to or larger than a predetermined distance. If an interval between sheets is set to avoid a collision between the sheets, however, it takes time to complete printing. Along with popularization of an image forming apparatus capable of executing double-sided printing, it is expected that a technique of shortening the time taken to complete printing is further improved. Japanese Patent Laid-Open No. 2014-21268 does not consider a technique of shortening, when double-sided printing and single-sided printing are successively executed, the time taken to complete double-sided printing and single-sided printing that are successively executed.

SUMMARY OF THE INVENTION

An aspect of the present invention is to eliminate the above-mentioned problems with the conventional technology. The present invention provides a conveyance apparatus and a control method that can shorten, when double-sided printing and single-sided printing are successively executed, the time taken to complete double-sided printing and single-sided printing that are successively executed, and a non-transitory computer-readable medium.

In one aspect of the present invention, a conveyance apparatus includes a conveyance unit configured to convey, using a conveyance path, a print medium to an image forming component configured to form an image on the print medium, a supply unit configured to supply the print medium to the conveyance path, a re-conveyance unit configured to re-convey, to the image forming component, the print medium, on which the image is formed by the image forming component, to perform double-sided printing, and a control unit configured to control, if a first print medium among supply target print media by the supply unit is a print medium to be used for single-sided printing and the print medium re-conveyed by the re-conveyance unit is located within a predetermined distance from a region where the first print medium is located on the conveyance path, the supply unit so that an interval between the region where the first print medium is located on the conveyance path and a region where a second print medium supplied to the conveyance path next to the first print medium is located on the conveyance path becomes a first interval, and to control, if the first print medium is a print medium to be used for single-sided printing and the print medium re-conveyed by the re-conveyance unit is not located within the predetermined distance from the region where the first print medium is located on the conveyance path, the supply unit so that the interval between the region where the first print medium is located on the conveyance path and the region where the second print medium is located on the conveyance path becomes a second interval shorter than the first interval.

According to the present invention, when double-sided printing and single-sided printing are successively executed, it is possible to shorten the time taken to complete double-sided printing and single-sided printing that are successively executed.

Further features of the present invention will become apparent from the following description of exemplary embodiments with reference to the attached drawings.

BRIEF DESCRIPTION OF THE DRAWINGS

FIGS. 7A to 7F are tables each showing information held in a RAM when the feed control processing is performed.

FIGS. 8A to 8F are tables each showing the information held in the RAM when the feed control processing is performed.

FIGS. 9A and 9B are tables each showing the information held in the RAM when the feed control processing is performed.

FIG. 10 is a table showing information of print jobs.

FIGS. 15A to 15F are tables each showing information held in a RAM when the feed control processing is performed.

FIGS. 16A to 16F are tables each showing the information held in the RAM when the feed control processing is performed.

FIG. 17 is a table showing the information held in the RAM when the feed control processing is performed.

FIG. 18 is a table showing information of print jobs.

FIGS. 23A to 23F are tables each showing information held in a RAM when the feed control processing is performed.

FIGS. 24A to 24F are tables each showing the information held in the RAM when the feed control processing is performed.

FIG. 25 is a table showing the information held in the RAM when the feed control processing is performed.

FIG. 26 is a table showing information of print jobs.

DESCRIPTION OF THE EMBODIMENTS

Figure 1:
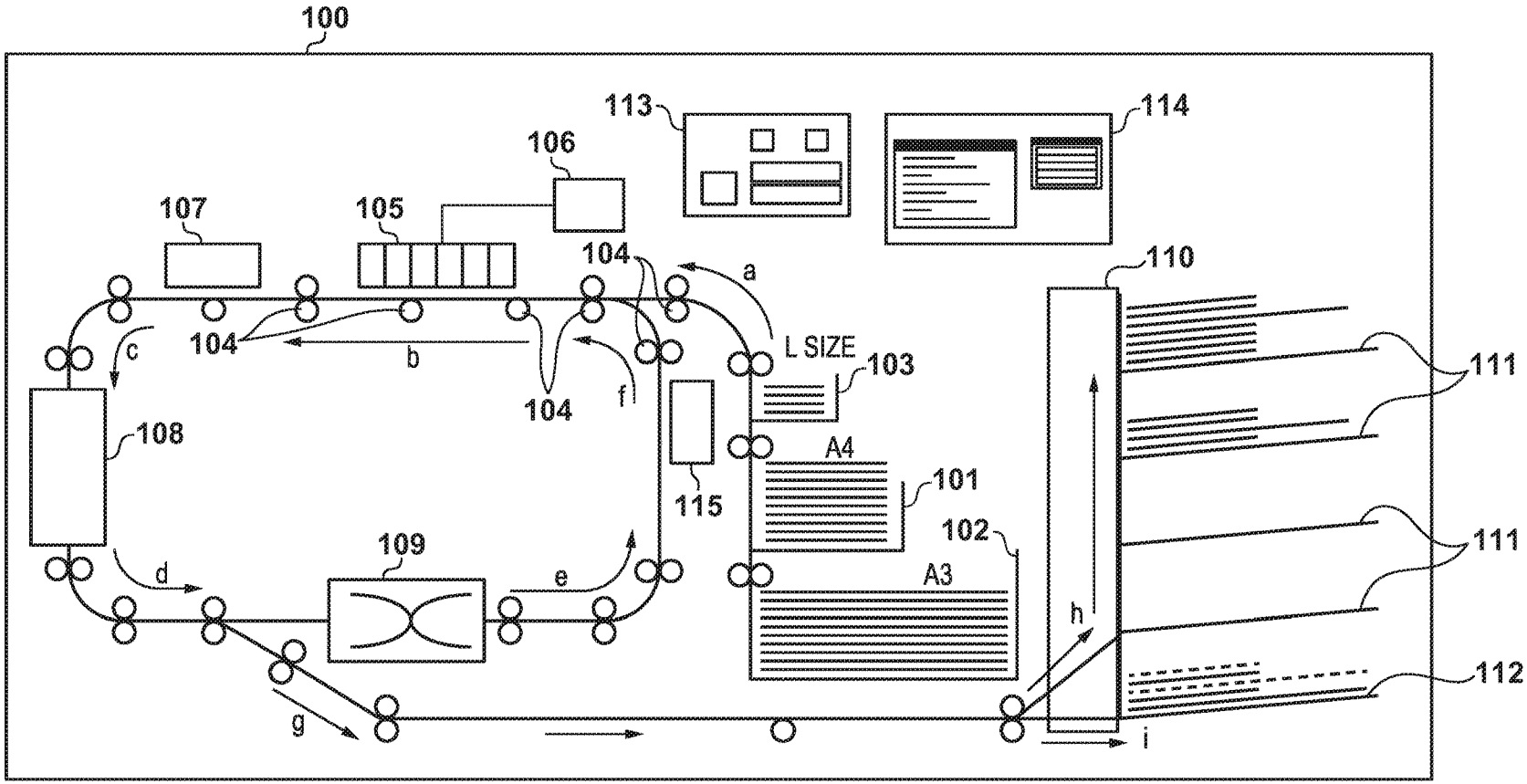
FIG. 1 is a view showing the overall arrangement of an image forming apparatus.

Preferred embodiments of the present invention will now be described hereafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same components and a description thereof will be omitted.

First Embodiment

An "image forming apparatus" is not limited to a dedicated device specialized in a print function, but also includes a multifunctional peripheral that combines a print function and other functions and an apparatus that forms an image or a pattern on a print sheet.

FIG. 1 is a view showing the overall arrangement of an image forming apparatus 100 using cut sheets (sheets that have been cut into predetermined sizes, such as L size, A4, and A3). The image forming apparatus 100 includes an A4 feeding tray 101, an A3 feeding tray 102, an L-size feeding tray 103, sheet-conveyance rotating rollers 104, printheads 105, a scanner unit 107, and a sensor 115. Note that the size of each feeding tray shown in FIG. 1 is merely an example, and each tray may be formed by a tray of another size. The image forming apparatus 100 also includes ink tanks 106, a drying unit 108, a sheet reversing unit 109, a sorting unit 110, and an operation unit 114. A control unit 113 incorporates a control substrate including a CPU, a user interface, and various kinds of I/O interfaces, and comprehensively controls the overall image forming apparatus 100.

A sheet (print medium) picked up by a pickup unit (rollers, or the like) (not shown) from the A4 feeding tray 101, the A3 feeding tray 102, or the L-size feeding tray 103 is conveyed by conveyance rollers in the direction of arrow "a" ("a" direction) in FIG. 1. That is, a print medium is supplied (arranged) onto a conveyance path from each tray. The sheet-conveyance rotating rollers 104 cause the sheet to advance in the direction of arrow "b" ("b" direction) in FIG. 1. Note that, in addition to the sheet-conveyance rotating rollers 104, rollers for sheet conveyance are arranged throughout the entire conveyance path of FIG. 1 and convey the sheet to a predetermined location by motor control. Note that the feeding trays are not limited to three stages, and one to a plurality of stages may be included depending on the arrangement of the image forming apparatus 100. The sheet fed from the A4 feeding tray 101, the A3 feeding tray 102, or the L-size feeding tray 103 passes below the printheads 105 (image forming component) through the conveyance path. As the printheads 105, independent line-type printheads of a plurality of colors (for example, six colors) are arrayed in the "b" direction as the sheet conveyance direction. The line-type printhead of each color may be formed by a single seamless nozzle chip, or may be formed by divided nozzle chips regularly arrayed in a line or in a staggered arrangement. In this embodiment, assume that a so-called full multi-printhead, in which nozzles are arranged in a range covering the printing width of a sheet of the maximum size to be used, is used. An image is formed on the sheet (print medium) by discharging ink droplets from the printheads 105 in synchronization with the conveyance of the sheet.

Each ink tank 106 stores each color ink independently. For each color, a tube is connected from each ink tank 106 to the corresponding printhead 105, and the ink is supplied. As an inkjet method of discharging ink droplets from nozzles, a method using heating elements, a method using piezoelectric elements, a method using electrostatic elements, a method using MEMS elements, or the like is adopted. Ink droplets are discharged from the nozzles of the printheads 105 based on print data. Note that this embodiment is not limited to a printer of the inkjet printing method, and is also applicable to printers of other printing methods, such as a thermal printer (a sublimation type, a thermal transfer type, or the like), a dot impact printer, an LED printer, and a laser printer.

The sheet on which the image is formed is conveyed by the sheet-conveyance rotating rollers 104 to the scanner unit 107. The scanner unit 107 optically reads a printed image or a special pattern, thereby confirming whether there is no problem with the printed image and confirming the state of the image forming apparatus 100. The scanner unit 107 can also read the state of the back surface opposite to the print surface, and can detect a shift between the printing positions on the front and back surfaces using a predetermined pattern.

The sheet conveyed from the scanner unit 107 is conveyed in the direction of arrow "c" ("c" direction) and passes through the drying unit 108. To dry the sheet applied with the ink droplets within a short time, the drying unit 108 heats the sheet with warm air while passing through the drying unit 108. A control unit (not shown) controls whether to convey the sheet having passed through the drying unit 108 in the direction of arrow "g" ("g" direction) in FIG. 1 or to the sheet reversing unit 109 after being conveyed in the direction of arrow "d" ("d" direction) in FIG. 1. More specifically, if the sheet having passed through the drying unit 108 is a sheet for which single-sided printing is executed, the sheet is controlled to be conveyed in the "g" direction of FIG. 1. On the other hand, if the sheet having passed through the drying unit 108 is a sheet for which double-sided printing is executed, the sheet is controlled to be conveyed to the sheet reversing unit 109. The sheet reversing unit 109 conveys the sheet so as to reverse the passing sheet. As a method of reversing the sheet, there is provided a switchback method, a method of slightly twisting the conveyance path, or the like. After passing through the sheet reversing unit 109, the sheet is conveyed in the direction of arrow "e" ("e" direction) in FIG. 1, and is in a reversed state at this point.

The reversed sheet passes below the sensor 115 through the conveyance path. The sensor 115 detects the sheet passing through the conveyance path. Based on, for example, a detection signal from the sensor 115, a CPU 201 can determine a feeding status indicating whether the sheet has been re-conveyed to the printing position of the printheads 105 for double-sided printing. When the sensor 115 detects that the sheet has passed below the sensor 115, if a sheet is newly supplied onto the conveyance path, the sheet passing below the sensor 115 may collide with the newly supplied sheet. To cope with this, in this embodiment, control is performed not to newly supply a sheet onto the conveyance path while the sheet passes below the sensor 115, which will be described in detail later. The conveyed sheet is further conveyed in the direction of arrow "f" ("f" direction) in FIG. 1, and is returned to the conveyance path in which the printheads 105 are arranged. In this manner, a path b-c-d-e-f-b in FIG. 1 is formed as a circulating path (conveyance path), and each sheet is controlled to be reversed upon making a round of this path. In this embodiment, the number of sheets that can be arranged simultaneously on the conveyance path will be referred to as a "circulable sheet count" hereafter. The circulable sheet count changes depending on the sheet size. For example, if the circulable sheet count of an A3 size is three, this indicates that a maximum of three A3 size sheets can be present simultaneously on the path b-c-d-e-f-b. In the alternate circulation method of alternately supplying a circulated sheet and a newly supplied sheet, there is no control for delaying supply of a sheet. To avoid a collision between the supplied sheet and the re-conveyed sheet, an odd number is generally set as the circulable sheet count.

The sheet for which printing is complete is branched in the g direction of FIG. 1 and conveyed without passing through the sheet reversing unit 109, and is then conveyed to the sorting unit 110. That is, the sheet of single-sided printing is branched in the g direction in the middle of the first round, and the sheet of double-sided printing is branched in the "g" direction in the middle of the second round. The sheet that is branched in the "g" direction and passes through the sorting unit 110 is stacked on a tray with a number set for each printed image while the position of the sheet is detected by the sensor 115. The sorting unit 110 holds a plurality of trays (for example, five stages), and a tray on which sheets are stacked is determined in accordance with the discharge method, such as a job unit method or copy unit method. The discharge method in the sorting unit 110 is not limited to the job unit method or copy unit method, and sheets may be stacked on another tray in the middle of one job unit or copy unit. Discharge trays 111 are trays used to discharge sheets having been printed satisfactorily, and a disposal tray 112 is a tray used to discard a sheet used in maintenance or a low-quality sheet. A sheet branched in the direction of arrow "h" ("h" direction) in FIG. 1 by the sorting unit 110 is conveyed to one of the discharge trays 111, and a sheet branched in the direction of arrow "i" ("i" direction) in FIG. 1 is conveyed to the disposal tray 112.

The operation unit 114 displays various interface screens. For example, the operation unit 114 displays information indicating a tray on which a designated order image is stacked, or a printing status for each order, such as printing, end of printing, or occurrence of an error. The operation unit 114 displays apparatus state information, such as the remaining ink amount and the remaining paper amount, and displays an operation screen for performing apparatus maintenance, such as cleaning of the printheads 105.

Figure 2:
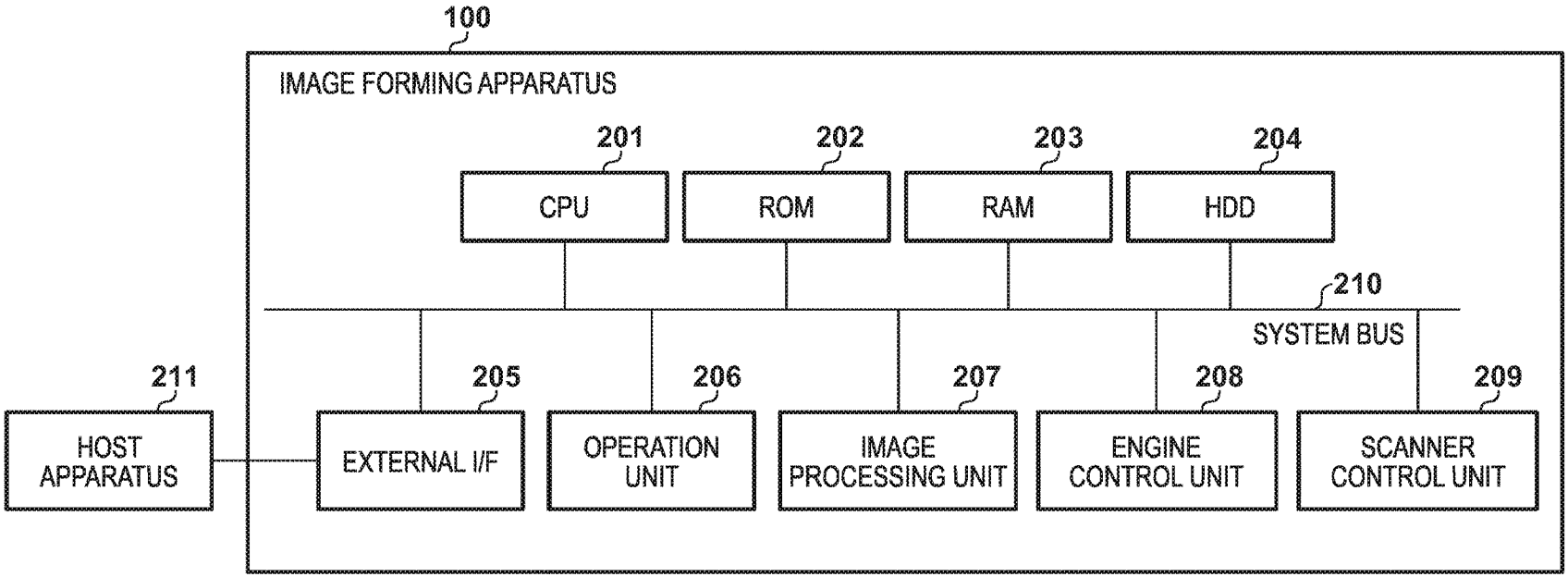
FIG. 2 is a block diagram showing the control arrangement of the image forming apparatus.

FIG. 2 is a block diagram showing the control arrangement of the image forming apparatus 100. The CPU 201 is mounted on the control unit 113 shown in FIG. 1, and comprehensively controls the overall image forming apparatus 100. A ROM 202 is a general-purpose ROM, and stores, for example, a control program and permanent data. A RAM 203 is a general-purpose RAM, and stores, for example, a print job and work data received from an external host apparatus 211. The print job is a job for causing the image forming apparatus 100 to execute printing, and includes, for example, print setting information and image data. Note that the print job may include print data as image data having undergone image processing. An HDD 204 is a hard disk, and stores, for example, image data received from the host apparatus 211. The host apparatus 211 is communicably connected to the image forming apparatus 100 via a wired or wireless network, and the print job transmitted from the host apparatus 211 is stored in the ROM 202 via an external interface (I/F) 205. Information of the print job is stored in a print job list in the RAM 203, and the image data, print data, and print setting information included in the print job are stored in the HDD 204.

An operation unit 206 corresponds to the operation unit 114 shown in FIG. 1, and includes a touch panel to, for example, accept an operation instruction input and registration of various kinds of data from an operator, and display the apparatus state information. An image processing unit 207 executes various kinds of image processes. For example, the image processing unit 207 converts the color space (for example, YCbCr) of the image data into a standard RGB color space (for example, sRGB). Furthermore, image processes such as resolution conversion into an effective pixel count, image analysis, and image correction are executed, as needed. Print data obtained by executing these image processes is stored in the RAM 203 or the HDD 204.

In accordance with a control command from the CPU 201, an engine control unit 208 performs control processing for printing an image on a sheet based on the print data. For example, the engine control unit 208 issues an ink discharge instruction to the printheads 105, sets the discharge timing to adjust the print dot position on the sheet, and acquires the printhead driving state. The engine control unit 208 controls driving of the printheads 105 in accordance with the print data, and causes the printheads 105 to discharge ink droplets, thereby forming an image on the sheet. The engine control unit 208 controls driving of the respective rollers by, for example, instructing to drive the feed rollers and conveyance rollers, and acquiring the rotation status of the conveyance rollers, and conveys the sheet at a suitable speed or stops the sheet.

In accordance with a control command from the CPU 201, a scanner control unit 209 controls an image sensor, such as a CCD or a CIS, to optically read an image on a sheet, and acquires analog luminance data of red (R), green (G), and blue (B). For example, the scanner control unit 209 instructs to drive the image sensor, acquires the status of the image sensor, analyzes the luminance data acquired from the image sensor, and detects non-discharge of ink and the cutting position of the sheet.

The host apparatus 211 has the arrangement of a general-purpose PC. Note that the host apparatus 211 need only be an apparatus serving as the supply source of a print job, and is, for example, an apparatus such as a mobile terminal, a personal computer (PC), a tablet terminal, a PDA (Personal Digital Assistant), or a digital camera. The host apparatus 211 may be connected to the image forming apparatus 100, and is formed as a reader unit for reading an image, or the like. In this case, the image forming apparatus 100 prints a sheet based on image data obtained by reading a document by the host apparatus 211. The print job, image data, command, status signal, and the like supplied from the host apparatus 211 are transmitted, or received to or from the image forming apparatus 100 via the external I/F 205. The respective blocks in the image forming apparatus 100 shown in FIG. 2 are communicably connected via a system bus 210.

The present invention is not limited to the arrangement shown in FIG. 2, and each unit may be divided into a plurality of units or each unit may hold a processor. Alternatively, at least one of the units may be formed by an ASIC, or the like.

Figures 3A, 3B, 3C:
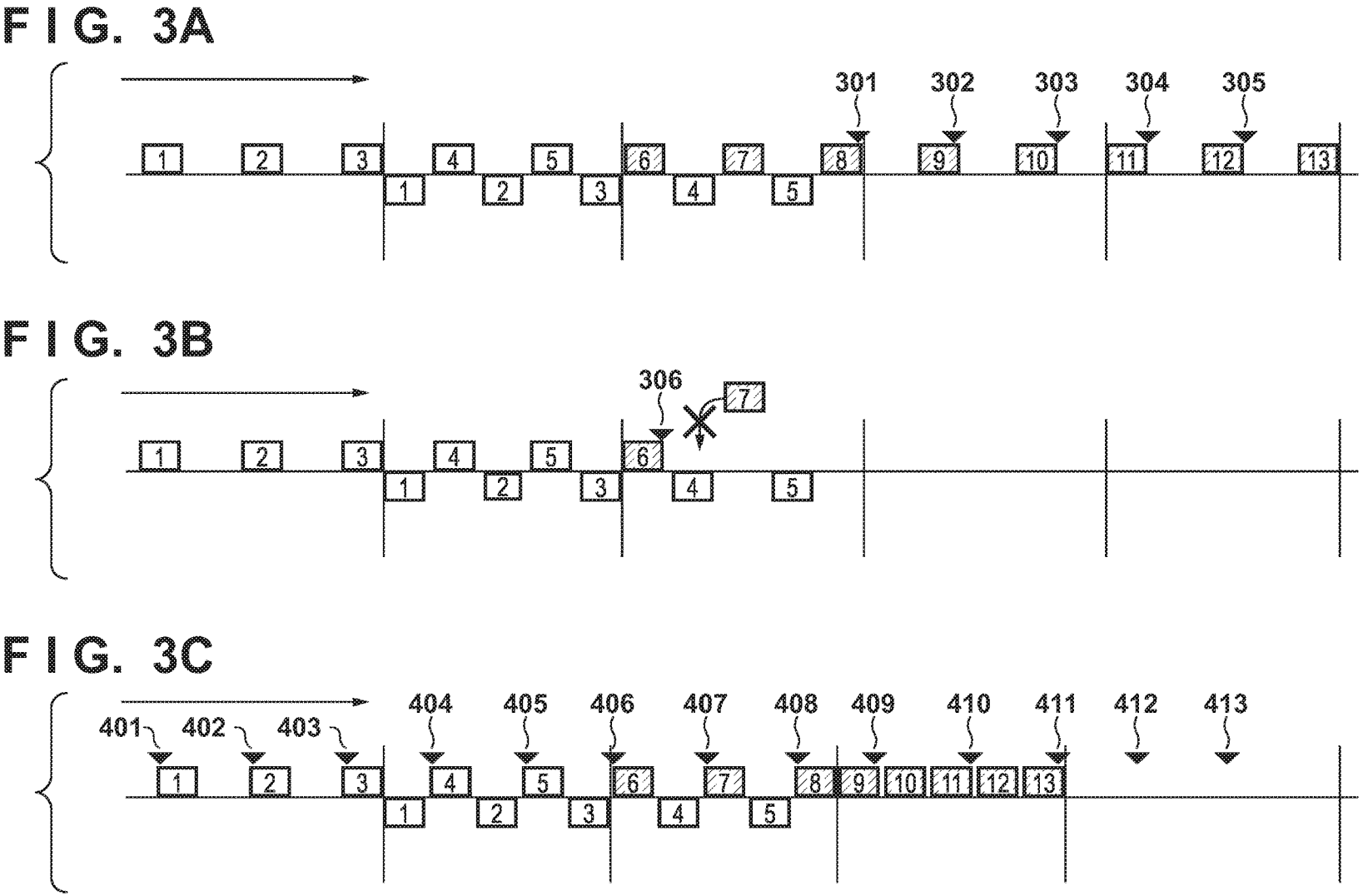
FIGS. 3A to 3C are views each showing a feed order when single-sided printing follows double-sided printing.

FIGS. 3A and 3B are views each showing a feed order when single-sided printing follows double-sided printing according to a conventional form. FIG. 3C is a view showing a feed order when single-sided printing follows double-sided printing in the image forming apparatus 100 according to this embodiment. Note that, in this embodiment, a print job for causing the image forming apparatus 100 to execute double-sided image formation will be referred to as a double-sided print job hereafter, and a print job for causing the image forming apparatus 100 to execute single-sided image formation will be referred to as a single-sided print job hereafter. Furthermore, a sheet supplied and conveyed based on a double-sided print job will be referred to as a double-sided print sheet hereafter, and a sheet supplied and conveyed based on a single-sided print job will be referred to as a single-sided print sheet hereafter. Note that the image forming apparatus 100 can discriminate whether each print job is a double-sided print job or a single-sided print job with reference to print setting information included in each print job. Note also that one job can cause the image forming apparatus 100 to execute both double-sided image formation and single-sided image formation. A print job for causing the image forming apparatus 100 to execute both double-sided image formation and single-sided image formation will be referred to as a mixed print job hereafter. Referring to FIGS. 3A to 3C, among rectangles above a horizontal line, each of solid frame line rectangles with a white interior indicates that a sheet is fed to print its surface based on a double-sided print job. Among the rectangles above the horizontal line, each of solid frame line rectangles with a hatched interior indicates that a sheet is fed to print one surface based on a single-sided print job. Furthermore, each of rectangles below the horizontal line indicates that a sheet whose back surface is printed based on the double-sided print job is conveyed (re-conveyed). A number (page number) indicating the ordinal number of the sheet from the first sheet is described in each rectangle. FIGS. 3A to 3C each show a feed order when a double-sided print job for executing double-sided printing on five A4-size sheets, and a single-sided print job for executing single-sided printing on eight A4-size sheets, are successively executed. Note that, in the case shown in FIGS. 3A to 3C, the circulable sheet count is five for the A4 size.

FIG. 3A shows a feed order when the above-described double-sided print job and single-sided print job are executed while keeping the sheet conveyance speed constant. Since printing is performed by setting a feed interval (to be referred to as a sheet interval or an interval between sheets hereafter) even in single-sided printing after the end of double-sided printing, however, spaces between sheets are large and the printing is not efficient. For example, a space between sheets is generated at each of feed timings (to be referred to as timings hereafter) 301, 302, 303, 304, and 305 of the eighth to 13th sheets in FIG. 3A.

On the other hand, FIG. 3B shows a feed order when the above-described double-sided print job and single-sided print job are executed by controlling to decrease all the sheet intervals in single-sided printing. As shown in FIG. 3B, if control is performed to decrease all the sheet intervals in single-sided printing, the seventh single-sided print sheet collides with the re-conveyed fourth double-sided print sheet at a timing 306.

To solve this problem, in this embodiment, as shown in FIG. 3C, if the supply target is a single-sided print sheet and no double-sided print sheet is re-conveyed to print the back surface, printing is executed without setting an interval for the supply target sheet. As a result, the image forming apparatus 100 can efficiently feed a sheet even when single-sided printing is executed subsequently to the double-sided printing.

Figure 4:
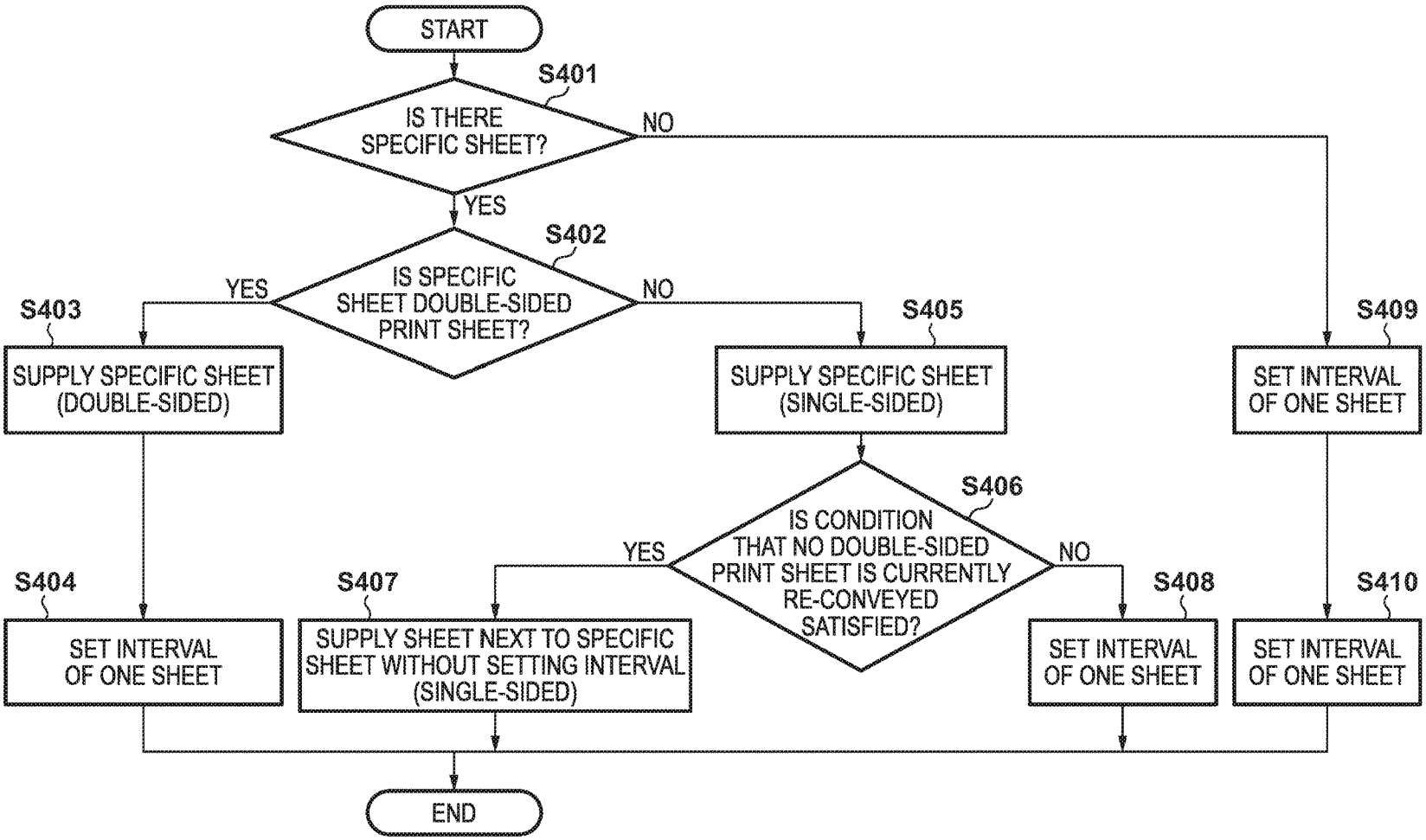
FIG. 4 is a flowchart illustrating feed control processing.

FIG. 4 is a flowchart illustrating feed control processing (feed scheduling processing) according to this embodiment. Note that the processing of FIG. 4 is implemented when, for example, the CPU 201 loads a program stored in the ROM 202 into the RAM 203 and executes it. Alternatively, the processing of FIG. 4 may be implemented by the engine control unit 208. The feed control processing of FIG. 4 may be periodically executed for every predetermined time at the timing when a sheet is fed or executed for every predetermined number of sheets at the timing when a print job is received from the host apparatus 211.

The feed control processing executed by the image forming apparatus 100 according to this embodiment will be described below with reference to FIG. 4. By executing the feed control processing once, whether to supply a sheet to each region of two sheets in the conveyance path is controlled, and, at most, two sheets are supplied. Note that the CPU 201 completes an operation of supplying all supply target sheets by repeating the processing from START to END in FIG. 4. Every time the processing of FIG. 4 is performed, the CPU 201 specifies a sheet with the smallest page number among supply target sheets that have not been supplied yet, and performs control (to be described later) with reference to the specified sheet. The specified sheet among the supply target sheets that have not been supplied yet will be referred to as a specific sheet hereafter. In this embodiment, assume that the processing shown in FIG. 4 is executed every time a conveyance path is driven by a distance of two sheets. The CPU 201 stores the result of the feed control processing of FIG. 4 in the RAM 203, and the engine control unit 208 performs print control on the sheet based on the print data in accordance with the result of the feed control processing and the control command from the CPU 201.

FIGS. 7A to 7F, 8A to 8F, 9A, and 9B each show an example of information held in the RAM 203 when the processing of FIG. 4 is executed at the timing when a print job is received from the host apparatus 211. Reference numerals 701, 702, and 703 denote data fields. The data field 701 indicates a feed ordinal number. The data field 702 indicates the page number of the supply target sheet. The data field 703 indicates whether the supply target sheet is a double-sided print sheet or a single-sided print sheet.

FIG. 10 shows information representing sheets supplied based on the print jobs received by the image forming apparatus 100 from the host apparatus 211. FIG. 10 shows information representing the sheets supplied based on the double-sided print job for executing double-sided printing on five A4-size sheets and the single-sided print job for executing single-sided printing on eight A4-size sheets. Reference numerals 1001 and 1002 denote data fields. The data field 1001 indicates the page number of the supply target sheet. The data field 1002 indicates whether the supply target sheet is a double-sided print sheet or a single-sided print sheet.

The feed control processing when single-sided printing follows double-sided printing according to this embodiment will be described below with reference to FIGS. 3A to 3C, 4, and 7A to 10. A case in which the double-sided print job for performing double-sided printing on five sheets and the single-sided print job for performing single-sided printing on eight sheets are received will now be explained. That is, information supplied based on the received jobs is as shown in FIG. 10. A case in which a sheet with page number 1 is specified as a specific sheet in the processing of FIG. 4 executed first will be described.

In step S401, the CPU 201 determines whether there is a specific sheet. If it is determined that there is a specific sheet, the process advances to step S402. Otherwise, the process advances to step S409. In this example, since there exists the sheet with page number 1 exists, the process advances to step S402.

In step S402, the CPU 201 determines whether the specific sheet is a double-sided print sheet. This determination processing is executed with reference to the data fields of FIG. 10. If it is determined that the specific sheet is a double-sided print sheet, the process advances to step S403. Otherwise, the process advances to step S405. In this example, since the sheet with page number 1 is a double-sided print sheet, the process advances to step S403.

In step S403, the CPU 201 controls the respective units to supply the specific sheet to the conveyance path. After the specific sheet is supplied to the conveyance path, the process advances to step S404. In this example, the sheet with page number 1 is supplied. In step S404, the CPU 201 stores information of the sheet supplied in step S403 in a column of feed number 1 of the data field shown in FIG. 7B. Furthermore, the CPU 201 controls not to supply a sheet to a region (a region of one sheet), on the conveyance path, within a predetermined distance from a region where the previously (step S403) supplied sheet is located (that is, the CPU 201 controls to set an interval of one sheet). Thus, the CPU 201 stores, in a column of feed number 2 of the data field shown in FIG. 7B, information (a blank in this embodiment) indicating that a sheet is supplied at the sheet interval. That is, in this example, the CPU 201 updates the information of FIG. 7A held in the RAM 203 to that of FIG. 7B. Then, the processing of FIG. 4 ends.

After that, the CPU 201 repeats the processing of FIG. 4 by handling each of the sheets with page numbers 2 to 5 as a specific sheet, and feeds the sheet through the same procedure (steps S401, S402, S403, and S404) as that described above. Note that, since all the sheets with page numbers 2 to 5 are double-sided print sheets, when supplying a sheet next, control is performed to supply the sheet to a region that is away, by a sheet interval of one sheet, from a region where the previously supplied sheet is located. Thus, in this example, the information of FIG. 7B held in the RAM 203 is updated to that of FIG. 7C after supplying the sheet with page number 2, and updated to that of FIG. 7D after supplying the sheet with page number 3. Then, the information is updated to that of FIG. 7E after supplying the sheet with page number 4, and updated to that of FIG. 7F after supplying the sheet with page number 5.

The CPU 201 repeats the processing of FIG. 4 again by handling the sheet with page number 6 as a specific sheet. That is, when the information held in the RAM 203 is in the state shown in FIG. 7F, the CPU 201 determines in step S401 whether there is a specific sheet. In this example, since the sheet with page number 6 exists, the process advances to step S402.

In step S402, the CPU 201 determines whether the specific sheet is a double-sided print sheet. In this example, since the sheet with page number 6 is a single-sided print sheet, the process advances to step S405. In step S405, the CPU 201 supplies the specific sheet onto the conveyance path. In this example, the CPU 201 supplies the sheet with page number 6 onto the conveyance path. After the specific sheet is supplied onto the conveyance path, the process advances to step S406.

In step S406, the CPU 201 determines whether a condition that no double-sided print sheet is currently re-conveyed at the position of the sensor 115 is satisfied. Note that this determination processing corresponds to processing of determining whether the re-conveyed double-sided print sheet is located in a region (for example, a region of one sheet), on the conveyance path, within the predetermined distance from a region where the previously (step S405) supplied sheet is located. Whether the double-sided print sheet is currently re-conveyed at the position of the sensor 115 can be determined with reference to, for example, a sheet detection signal by the sensor 115 or to the data fields of FIGS. 7A to 7F or FIG. 10. More specifically, for example, the above-described determination processing can be performed with reference to information indicating whether a sheet corresponding to a feed number one round of the conveyance path before a feed number next to the feed number of the sheet supplied in step S405 is a double-sided print sheet. If it is determined that the condition is satisfied, the process advances to step S407. Otherwise, the process advances to step S408. In this example, since the sheet corresponding to the feed number (feed number 7) one round (corresponding to five sheets) of the conveyance path before the feed number (feed number 12) next to the feed number of the sheet supplied in step S405 is a double-sided print sheet, the process advances from step S406 to step S408.

In step S408, the CPU 201 controls not to supply a sheet to the region (a region of one sheet) within the predetermined distance from the region where the previously (step S403) supplied sheet is located.

This is because the double-sided print sheet is already arranged in the region within the predetermined distance from the position at which the sheet is supplied previously (step S403). Therefore, the CPU 201 stores, in a column of feed number 12 of the data field shown in FIG. 8A, information (a blank in this embodiment) indicating that a sheet is supplied at the sheet interval. That is, the CPU 201 updates the information of FIG. 7F held in the RAM 203 to that of FIG. 8A. Then, the processing of FIG. 4 ends. Since the control in step S408 sets an interval of one sheet between the sheet supplied in step S405 and a sheet supplied next, it is possible to prevent a collision between the newly supplied sheet and the sheet existing on the conveyance path.

After that, the CPU 201 repeats the processing of FIG. 4 by handling the sheet with page number 7 as a specific sheet, and feeds the sheet through the same procedure (steps S401, S402, S405, S406, and S408) as that described above. This updates the information of FIG. 8A held in the RAM 203 to that of FIG. 8B after feeding the single-sided print sheet with page number 7.

After that, the CPU 201 repeats the processing of FIG. 4 by handling the sheet with page number 8 as a specific sheet. That is, when the information held in the RAM 203 is in the state shown in FIG. 8B, the CPU 201 determines in step S401 whether there is a specific sheet. In this example, since the sheet with page number 8 exists, the process advances to step S402.

In step S402, the CPU 201 determines whether the specific sheet is a double-sided print sheet. In this example, since the sheet with page number 8 is a single-sided print sheet, the process advances to step S405. In step S405, the CPU 201 feeds the specific sheet onto the conveyance path. In this example, the CPU 201 supplies the sheet with page number 8 onto the conveyance path. After the specific sheet is supplied onto the conveyance path, the process advances to step S406.

In step S406, the CPU 201 determines whether the condition that no sheet is currently re-conveyed at the position of the sensor 115 is satisfied. In this example, since the sheet corresponding to the feed number (feed number 11) one round (corresponding to five sheets) of the conveyance path before the feed number (feed number 16) next to the feed number of the sheet supplied in step S405 is a single-sided print sheet, the condition is not satisfied. Therefore, the process advances from step S406 to step S407.

In step S407, the CPU 201 supplies the sheet next to the current specific sheet without setting an interval with respect to the sheet supplied in step S405. In this example, the CPU 201 supplies the sheet with page number 9 without setting an interval with respect to the sheet with page number 8, and updates the information of FIG. 8B held in the RAM 203 to that of FIG. 8C. After that, the processing of FIG. 4 ends. Note that, in this embodiment, when sheets are conveyed without setting a sheet interval, the sheets may actually be conveyed at a predetermined small sheet interval.

After that, the CPU 201 repeats the processing of FIG. 4 by handling each of the sheets with page numbers 10 and 11 as a specific sheet, and feeds the sheet without setting an interval between the sheets through the same procedure (steps S401, S402, S405, S406, and S407) as that described above. This updates the information of FIG. 8C held in the RAM 203 to that of FIG. 8D after supplying the sheet with page number 11.

After that, the CPU 201 repeats the processing of FIG. 4 by handling each of the sheets with page numbers 12 and 13 as a specific sheet, and supplies the sheet without setting an interval between the sheets through the same procedure (steps S401, S402, S405, S406, and S407) as that described above. This updates the information of FIG. 8D held in the RAM 203 to that of FIG. 8E after supplying the sheet with page number 13.

After supplying the sheet with page number 13, the CPU 201 determines in step S401 whether there is a specific sheet. In this example, there is no sheet with page number 14, the process advances from step S401 to step S409.

In step S409, the CPU 201 drives the conveyance path by a distance of one sheet without supplying any sheet. That is, the CPU 201 controls not to newly supply a sheet to a region of one sheet (that is, controls to set an interval of one sheet), and advances to step S410. In step S410, the CPU 201 controls not to newly supply a sheet to a region of one sheet from the position of the region that has been controlled not to be supplied with a sheet in step S409 (that is, controls to set an interval of one sheet). This supplies the next sheet to a position that is away by a sheet interval of at least two sheets. Note that the reason why the CPU 201 sets a sheet interval of two sheets is to avoid a collision between the sheet supplied next and the re-conveyed sheet. After that, the CPU 201 updates the information of FIG. 8E held in the RAM 203 to that of FIG. 8F. Then, the processing of FIG. 4 ends.

After that, in step S401, the CPU 201 determines whether there is a specific sheet. In this example, since there is no specific sheet, the process advances to step S409. After that, as described above, a sheet interval of one sheet is set in each of steps S409 and 5410, and the processing of FIG. 4 ends. The information of FIG. 8F held in the RAM 203 is updated to that of FIG. 9A.

After that, in step S401, the CPU 201 determines whether there is a specific sheet. In this example, since there is no next specific sheet, the process advances to step S409. After that, as described above, a sheet interval of one sheet is set in each of steps S409 and S410, and the processing of FIG. 4 ends. The information of FIG. 9A held in the RAM 203 is updated to that of FIG. 9B. That is, as long as there is no job to be processed and there is no supply target sheet, a sheet interval is set.

Note that, in the above-described control, a sheet undergoing single-sided printing is discharged earlier than a sheet undergoing double-sided printing. The form in which the first to fifth sheets undergoing double-sided printing and the sixth to thirteenth sheets undergoing single-sided printing are printed by different jobs has been explained above. Thus, if the sheets corresponding to each job are discharged to a different discharge unit for each job, the correspondence between the discharge order and the page numbers is maintained. In the above-described control, however, for example, if a mixed print job is processed, sheets undergoing double-sided printing and sheets undergoing single-sided printing are discharged to the same discharge unit, and thus, the discharge order may not correspond to the page numbers. In this case, therefore, supply of sheets to undergo single-sided printing may stand by until re-conveyance of sheets undergoing double-sided printing is completed. More specifically, for example, in the processing of the mixed print job for executing single-sided printing on eight A4-size sheets after performing double-sided printing on five A4-size sheets, the CPU 201 performs the above-described control up to feed number 10. Then, the CPU 201 makes a feed operation stand by until feed number 14, and starts to feed a sheet to undergo single-sided printing from feed number 15. This can make the discharge order correspond to the page numbers even if the mixed print job is processed.

The example in which the processing of FIG. 4 starts at the timing when the print job is received from the host apparatus 211, and the processing of FIG. 4 is executed again every time the conveyance path is driven by a distance of two sheets has been explained above. The processing of FIG. 4 may, however, be periodically executed for every predetermined time at the timing when a sheet is fed. In this case, the above-described processing of FIG. 4 corresponding to each change in information shown in each of FIGS. 7A to 9B corresponds to the processing of FIG. 4 executed at each of timings 401 to 413 in FIG. 3C. In either of the execution methods, obtained feed intervals are as shown in FIG. 3C.

Figure 5:
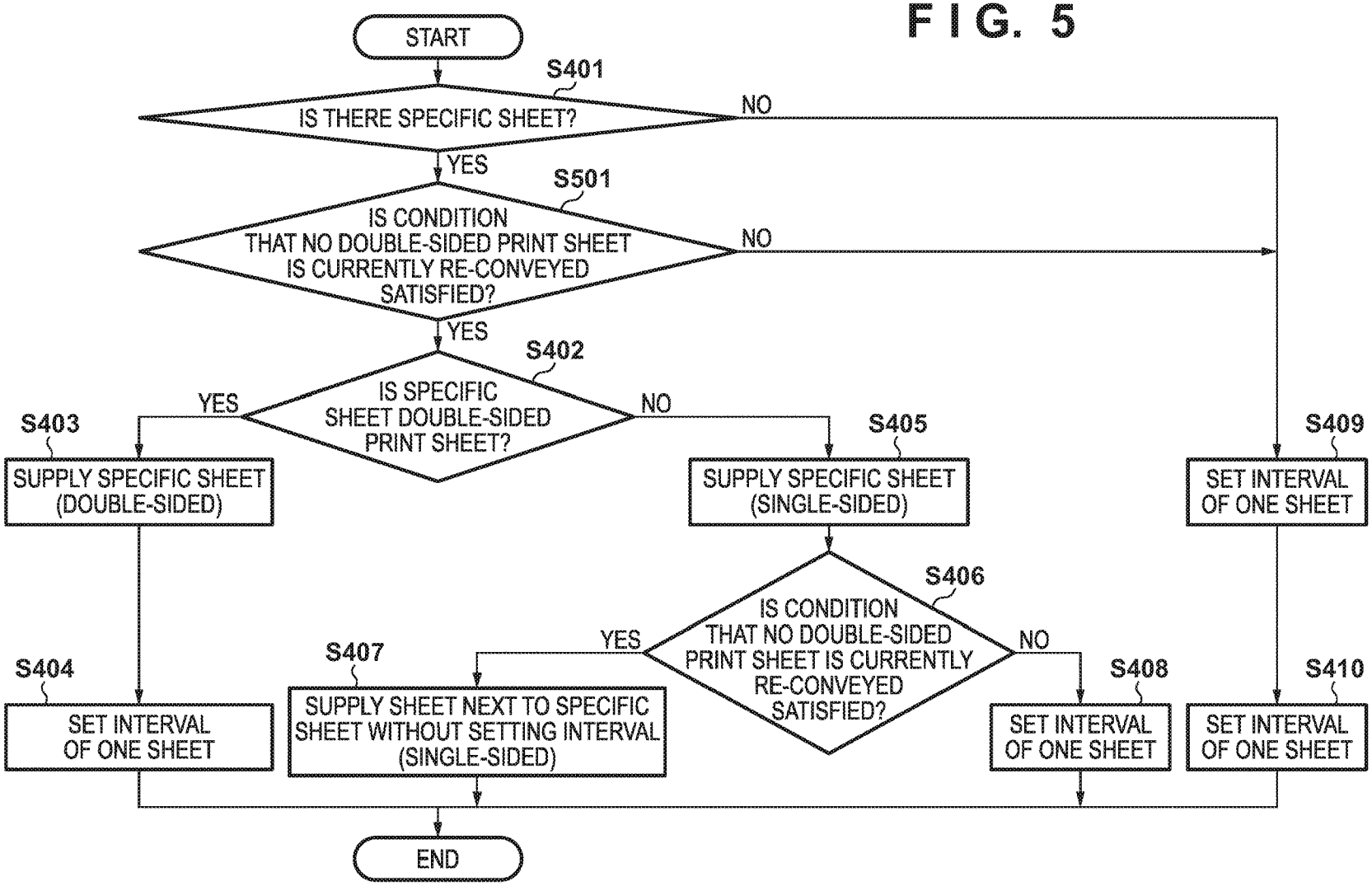
FIG. 5 is a flowchart illustrating feed control processing.

In FIG. 4, only when the specific sheet is a single-sided print sheet, it is determined in step S406 whether the double-sided print sheet is currently re-conveyed. As shown in FIG. 5, however, even if the specific sheet is a double-sided print sheet, it may be determined whether the double-sided print sheet is currently re-conveyed. That is, instead of the processing shown in FIG. 4, processing shown in FIG. 5 may be executed. Referring to FIG. 5, in step S501 after the processing in step S401, the CPU 201 determines whether the double-sided print sheet is currently re-conveyed at the position of the sensor 115. As described above, by executing, twice, at each timing, the processing of determining whether the sheet is currently re-conveyed, it is possible to reduce the possibility that the sheets collide with each other.

Figure 6:
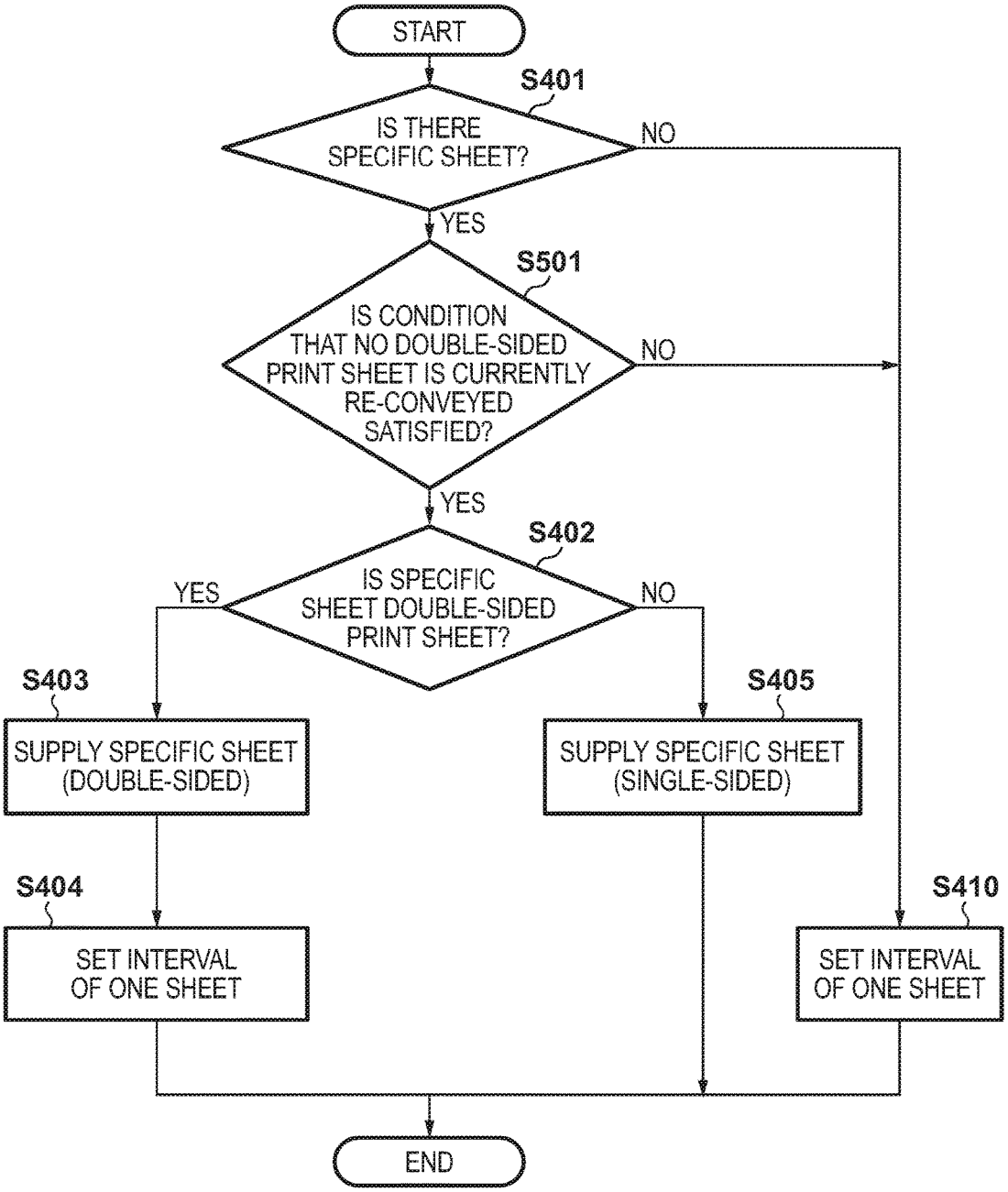
FIG. 6 is a flowchart illustrating feed control processing.

In FIG. 4, for example, after supplying the sixth sheet (single-sided print sheet) in step S405, an interval of one sheet is set before supplying the seventh sheet (single-sided print sheet) in step S408. Furthermore, for example, after supplying the eighth sheet (single-sided print sheet) in step S405, the ninth sheet (single-sided print sheet) is supplied in step S407. That is, in FIG. 4, whether to supply a sheet is controlled for each region of two sheets in the conveyance path. As shown in FIG. 6, however, whether to supply a sheet may be controlled for a region of one sheet or a region of two sheets in the conveyance path. This arrangement can simplify the processing. Results obtained by the processes of FIGS. 5 and 6 are the same as those of FIG. 4.

Note that the sensor 115 shown in FIG. 1 may be installed at any position between the sheet reversing unit 109 and the meeting point of the paths of the "f" direction and the "a" direction, and the position is not limited to a position immediately before the meeting point. The timing of the feed processing shown in FIG. 3C, that is, the timing at which the processing of FIG. 4 is performed may be the timing at which the sheet passes through the point of the sensor 115.

As described above, in this embodiment, whether to set a supply interval between single-sided print sheets is controlled in accordance with determination of whether a double-sided print sheet is currently re-conveyed. As a result, it is possible to decrease the sheet interval between single-sided print sheets in accordance with the status. In either a case in which only a single-sided print job is executed or a case in which a double-sided print job and a single-sided print job are successively processed, it is possible to efficiently print while keeping the sheet conveyance speed constant.

Second Embodiment

Figure 11A:
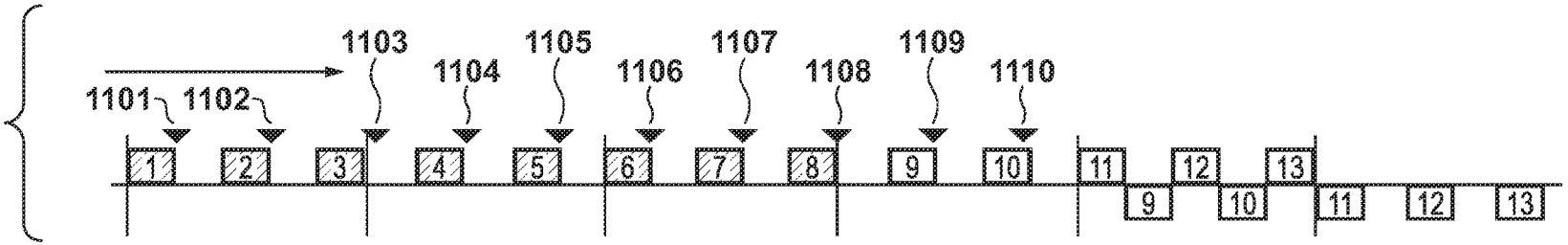
FIGS. 11A and 11B are views each showing a feed order when double-sided printing follows single-sided printing.
Figure 11B:
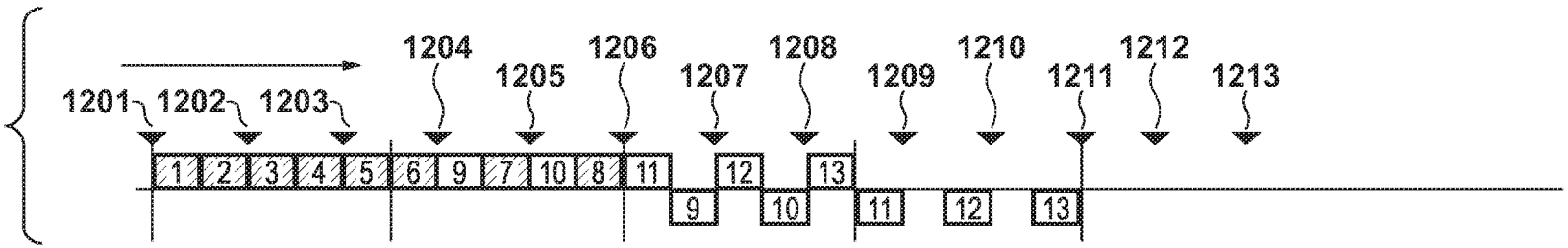

In the second embodiment, the difference from the first embodiment will be described below. FIG. 11A is a view showing a feed order when a double-sided print job follows a single-sided print job according to the conventional form. FIG. 11B is a view showing a feed order when double-sided printing follows single-sided printing in an image forming apparatus 100 according to this embodiment. Note that FIGS. 11A and 11B each show a feed order when a single-sided print job for executing single-sided printing on eight A4-size sheets and a double-sided print job for executing double-sided printing on five A4-size sheets are successively executed. In FIGS. 11A and 11B, the circulable sheet count is five for the A4size.

Referring to FIG. 11A, it is possible to print while keeping the sheet conveyance speed constant. Since, however, printing is performed by setting a sheet interval in single-sided printing, spaces between sheets are large, and the printing is not efficient. In addition, even when starting double-sided printing, a space between sheets is generated. For example, a space between sheets is generated at each of timings 1101, 1102, 1103, 1104, 1105, 1106, 1107, 1108, 1109, and 1110 of the first to 11th sheets in FIG. 11A.

To cope with this problem, in this embodiment, if a specific sheet is a single-sided print sheet, it is determined whether there exists a double-sided print sheet to be supplied a predetermined number of sheets after the specific sheet. Based on the determination result, the feed order is changed, as shown in FIG. 11B. By adopting this form, it is possible to efficiently print while keeping the sheet conveyance speed constant in either a case in which only a single-sided print job is executed, or a case in which a double-sided print job and a single-sided print job are successively processed.

Figure 12A:
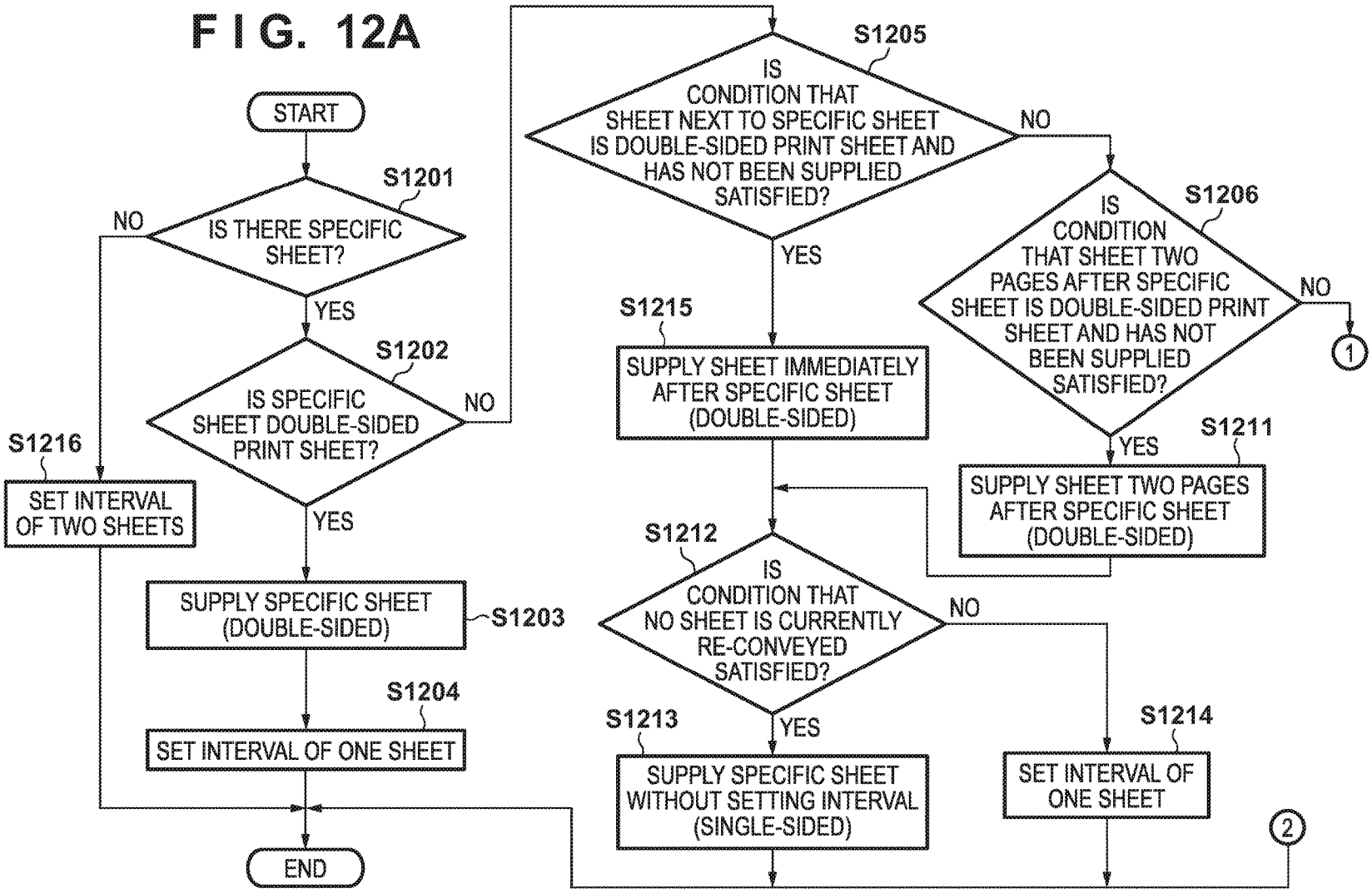
FIGS. 12A and 12B are flowcharts illustrating feed control processing.
Figure 12B:
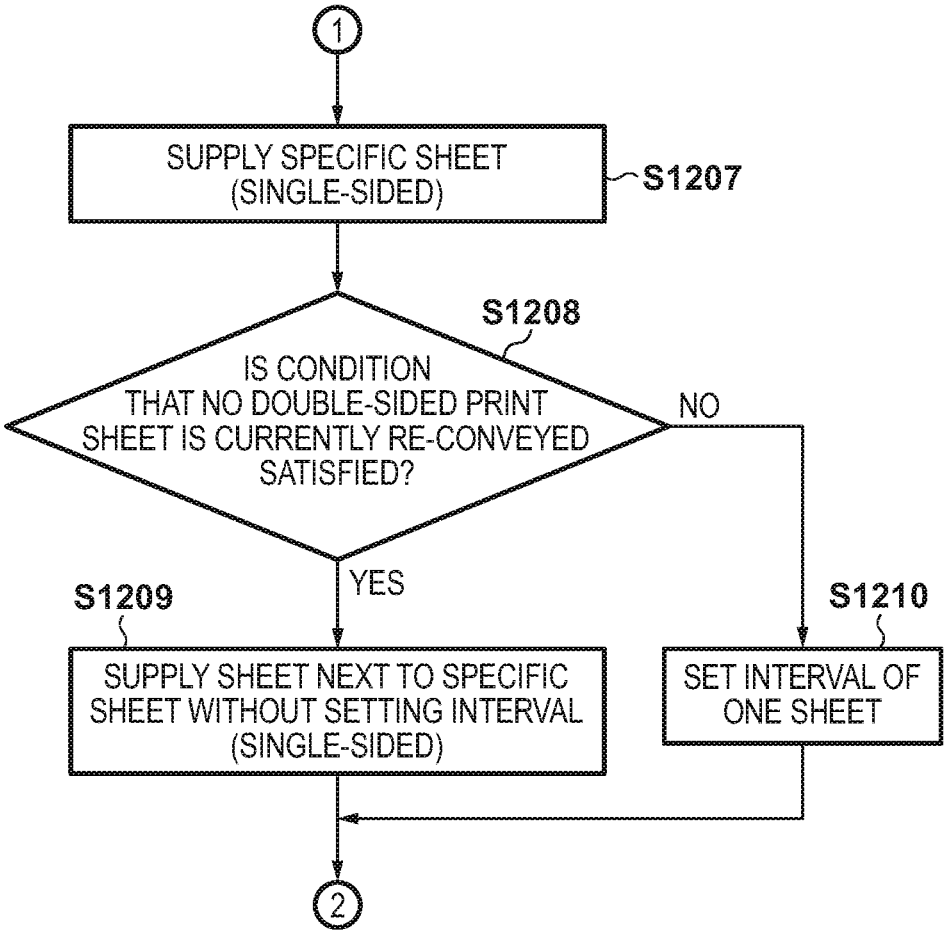

FIGS. 12A and 12B are flowcharts illustrating feed control processing executed by the image forming apparatus 100 according to this embodiment. Note that the processing of FIGS. 12A and 12B is implemented when, for example, a CPU 201 loads a program stored in a ROM 202 into a RAM 203 and executes the program. Alternatively, the processing of FIGS. 12A and 12B may be implemented by an engine control unit 208. The feed control processing of FIGS. 12A and 12B may be periodically executed for every predetermined time at the timing when a sheet is fed or executed at the timing when a print job is received from a host apparatus 211. In either of the methods, the result shown in FIG. 11B is obtained.

The feed control processing executed by the image forming apparatus 100 according to this embodiment will be described below with reference to FIGS. 12A and 12B. By executing the feed control processing once, at most two sheets are supplied. Note that the CPU 201 completes an operation of supplying all supply target sheets by repeating the processing from START to END in FIGS. 12A and 12B. Every time the processing of FIGS. 12A and 12B is performed, the CPU 201 specifies a sheet with the smallest page number among supply target sheets that have not been supplied yet, and performs control (to be described later) with reference to the specified sheet (specific sheet). In this embodiment, assume that the processing shown in FIGS. 12A and 12B is executed every time a conveyance path is driven by a distance of two sheets. The CPU 201 stores the result of the feed control processing of FIGS. 12A and 12B in the RAM 203, and the engine control unit 208 performs print control on the sheet based on print data in accordance with the result of the feed control processing and a control command from the CPU 201.

In this embodiment, if the circulable sheet count is N, double-sided print sheets included in M (M=largest integer equal to or smaller than N/2) supply target sheets subsequent to the single-sided print sheet as the specific sheet are printed prior to the specific sheet. For example, if the circulable sheet count is five, double-sided print sheets included in two supply target sheets subsequent to the single-sided print sheet as the specific sheet are precedingly printed. If the circulable sheet count is seven, double-sided print sheets included in three supply target sheets subsequent to the single-sided print sheet as the specific sheet are precedingly printed.

FIGS. 15A to 15F, 16A to 16F, and 17 each show an example of information held in the RAM 203 when the processing of FIGS. 12A and 12B is executed at the timing when a print job is received from the host apparatus 211. Reference numerals 1501, 1502, and 1503 denote data fields. The data field 1501 indicates a feed ordinal number. The data field 1502 indicates the page number of the supply target sheet. The data field 1503 indicates whether the supply target sheet is a double-sided print sheet or a single-sided print sheet.

FIG. 18 shows information representing sheets supplied based on the print jobs received by the image forming apparatus 100 from the host apparatus 211. Note that FIG. 18 shows information representing the sheets supplied based on a single-sided print job for executing single-sided printing on eight A4-size sheets and a double-sided print job for executing double-sided printing on five A4-size sheets. Reference numerals 1801 and 1802 denote data fields. The data field 1801 indicates the page number of the supply target sheet. The data field 1802 indicates whether the supply target sheet is a double-sided print sheet or a single-sided print sheet.

The feed control processing of FIGS. 12A and 12B performed at each timing when double-sided printing follows single-sided printing according to this embodiment will be described below with reference to FIGS. 11B, 12A and 12B, and 15A to 18. A case in which a sheet with page number 1 is specified as a specific sheet in the processing of FIGS. 12A and 12B executed first will be described.

At a timing 1201 of FIG. 11B, in step S1201, the CPU 201 determines whether there is a specific sheet. If it is determined that there is a specific sheet, the process advances to step S1202. Otherwise, the process advances to step S1216. In this example, since the sheet with page number 1 exists, the process advances to step S1202.

In step S1202, the CPU 201 determines whether the specific sheet is a double-sided print sheet. This determination processing is executed with reference to the data fields of FIG. 18. If it is determined that the specific sheet is a double-sided print sheet, the process advances to step S1203. Otherwise, the process advances to step S1205. In this example, since the sheet with page number 1 is not a double-sided print sheet but a single-sided print sheet, the process advances to step S1205.

In step S1205, the CPU 201 determines whether a condition that a sheet next to the current specific sheet is a double-sided print sheet and has not been supplied is satisfied. If it is determined that the condition is satisfied, the process advances to step S1215. Otherwise, the process advances to step S1206. In this example, since the sheet (page number 2) next to the current specific sheet is not a double-sided print sheet but a single-sided print sheet, it is determined that the condition is not satisfied and the process advances to step S1206.

In step S1206, the CPU 201 determines whether a condition that a sheet two pages after the current specific sheet is a double-sided print sheet and has not been supplied is satisfied. If it is determined that the condition is satisfied, the process advances to step S1211. Otherwise, the process advances to step S1207. In this example, since the sheet (page number 3) two pages after the current specific sheet is not a double-sided print sheet but a single-sided print sheet, it is determined that the condition is not satisfied, and the process advances to step S1207.

In step S1207, the CPU 201 supplies the specific sheet onto the conveyance path. In this example, the CPU 201 supplies the sheet with page number 1, and advances to step S1208. In step S1208, the CPU 201 determines whether a condition that no double-sided print sheet is currently re-conveyed at the position of a sensor 115 is satisfied. Note that whether the double-sided print sheet is currently re-conveyed at the position of the sensor 115 can be determined by, for example, detecting the sheet by the sensor 115 or referring to the data fields of FIGS. 16A to 16F or FIG. 18. More specifically, for example, the above-described determination processing can be performed with reference to information indicating whether a sheet corresponding to a feed number one round of the conveyance path before a feed number next to the feed number of the sheet supplied in step S1207 is a double-sided print sheet. If it is determined that the condition is satisfied, the process advances to step S1209. Otherwise, the process advances to step S1210. In this example, since no double-sided print sheet is currently re-conveyed at the position of the sensor 115, it is determined that the condition is satisfied and the process advances to step S1209. In step S1209, the CPU 201 supplies the sheet next to the current specific sheet without setting an interval with respect to the position at which the specific sheet is supplied, and ends the processing of FIGS. 12A and 12B. That is, in this example, the CPU 201 supplies the sheet with page number 1 and the sheet with page number 2 without setting a sheet interval. Note that, in this embodiment, when sheets are conveyed without setting a sheet interval, the sheets may actually be conveyed at a predetermined small sheet interval.

Next, the CPU 201 repeats the processing of FIGS. 12A and 12B by handling each of the sheets with page numbers 3 to 6 as a specific sheet, and feeds the sheet through the same procedure as that at the timing 1201.

The CPU 201 repeats the processing of FIGS. 12A and 12B by handling the sheet with page number 7 as a specific sheet. That is, at a timing 1204 of FIG. 11B, in step S1201, the CPU 201 determines whether there is a specific sheet. In this example, since the sheet with page number 7 exists, the process advances to step S1202.

In step S1202, the CPU 201 determines whether the specific sheet is a double-sided print sheet. In this example, since the sheet with page number 7 is not a double-sided print sheet but a single-sided print sheet, the process advances to step S1205.

In step S1205, the CPU 201 determines whether the condition that a sheet next to the current specific sheet is a double-sided print sheet and has not been supplied is satisfied. In this example, since the sheet with page number 8 is not a double-sided print sheet but a single-sided print sheet, it is determined that the condition is not satisfied, and the process advances to step S1206.

In step S1206, the CPU 201 determines whether the condition that a sheet two pages after the current specific sheet is a double-sided print sheet and has not been supplied is satisfied. In this example, since the sheet (page number 9) two pages after the current specific sheet is a double-sided print sheet and has not been supplied, it is determined that the condition is satisfied, and the process advances to step S1211.

In step S1211, the CPU 201 supplies the sheet two pages after the current specific sheet, and advances to step S1212.

In step S1212, the CPU 201 determines whether a double-sided print sheet is currently re-conveyed at the position of the sensor 115. In this example, since no double-sided print sheet is currently re-conveyed at the position of the sensor 115, the process advances to step S1213. In step S1213, the CPU 201 supplies the specific sheet without setting an interval with respect to a region where the previously supplied sheet is located. That is, in this example, the CPU 201 supplies the sheet with page number 9 before supplying the sheet with page number 7. Furthermore, the CPU 201 supplies the sheet with page number 9 and the sheet with page number 7 without setting a sheet interval. Note that in step S1214, the CPU 201 controls not to supply a sheet to a region (a region of one sheet), on the conveyance path, within a predetermined distance from the region where the previously supplied sheet is located.

At a timing 1205 of FIG. 11B, the CPU 201 handles the sheet with page number 8 as a specific sheet, feeds the sheet through the same procedure as that at the timing 1204, and then ends the processing of FIGS. 12A and 12B. That is, the CPU 201 supplies the sheet with page number 10 before supplying the sheet with page number 8. Furthermore, the CPU 201 supplies the sheet with page number 10 and the sheet with page number 8 without setting a sheet interval.

Next, at a timing 1206 of FIG. 11B, the processing of FIGS. 12A and 12B is repeated again by handling the sheet with page number 11 as a specific sheet. In step S1201, the CPU 201 determines whether there is a specific sheet. In this example, since the sheet with page number 11 exists, the process advances to step S1202.

In step S1202, the CPU 201 determines whether the specific sheet is a double-sided print sheet. In this example, since the sheet with page number 11 is a double-sided print sheet, the process advances to step S1203. In step S1203, the CPU 201 supplies the specific sheet onto the conveyance path. In this example, the CPU 201 supplies the sheet with page number 11, and advances to step S1204.

In step S1204, the CPU 201 controls not to supply a sheet to a region (a region of one sheet) within a predetermined distance from a position at which the sheet with page number 11 is supplied, and ends the processing of FIGS. 12A and 12B.

At each of timings 1207 and 1208 of FIG. 11B, the CPU 201 repeats the processing of FIGS. 12A and 12B by handling each of the sheets with page numbers 12 and 13 as a specific sheet, and feeds the sheet through the same procedure as that at the timing 1206.

At a timing 1209 of FIG. 11B, in step S1201, the CPU 201 determines whether there is a specific sheet. In this example, since there is no sheet with page number 14, the process advances to step S1216. In step S1216, the CPU 201 drives the conveyance path by a distance of two sheets without supplying any sheet. That is, the CPU 201 controls not to newly supply a sheet to a region of two sheets (that is, controls to set an interval of two sheets), and ends the processing of FIGS. 12A and 12B.

At each of timings 1210, 1211, 1212, and 1213 of FIG. 11B, the CPU 201 sets a sheet interval of two sheets through the same procedure as that at the timing 1209, and ends the processing of FIGS. 12A and 12B. That is, as long as there is no job to be processed and there is no supply target sheet, a sheet interval is set.

This embodiment has explained the example in which the processing is periodically executed for every predetermined time at the timing when a sheet is fed. If the processing is performed for every two sheets at the timing when a print job is received from the host apparatus 211, when the processing of FIGS. 12A and 12B is executed at each of the timings 1201 to 1213 of FIG. 11B, the information held in the RAM 203 changes, as shown in FIGS. 15A to 17.

Figure 13A:
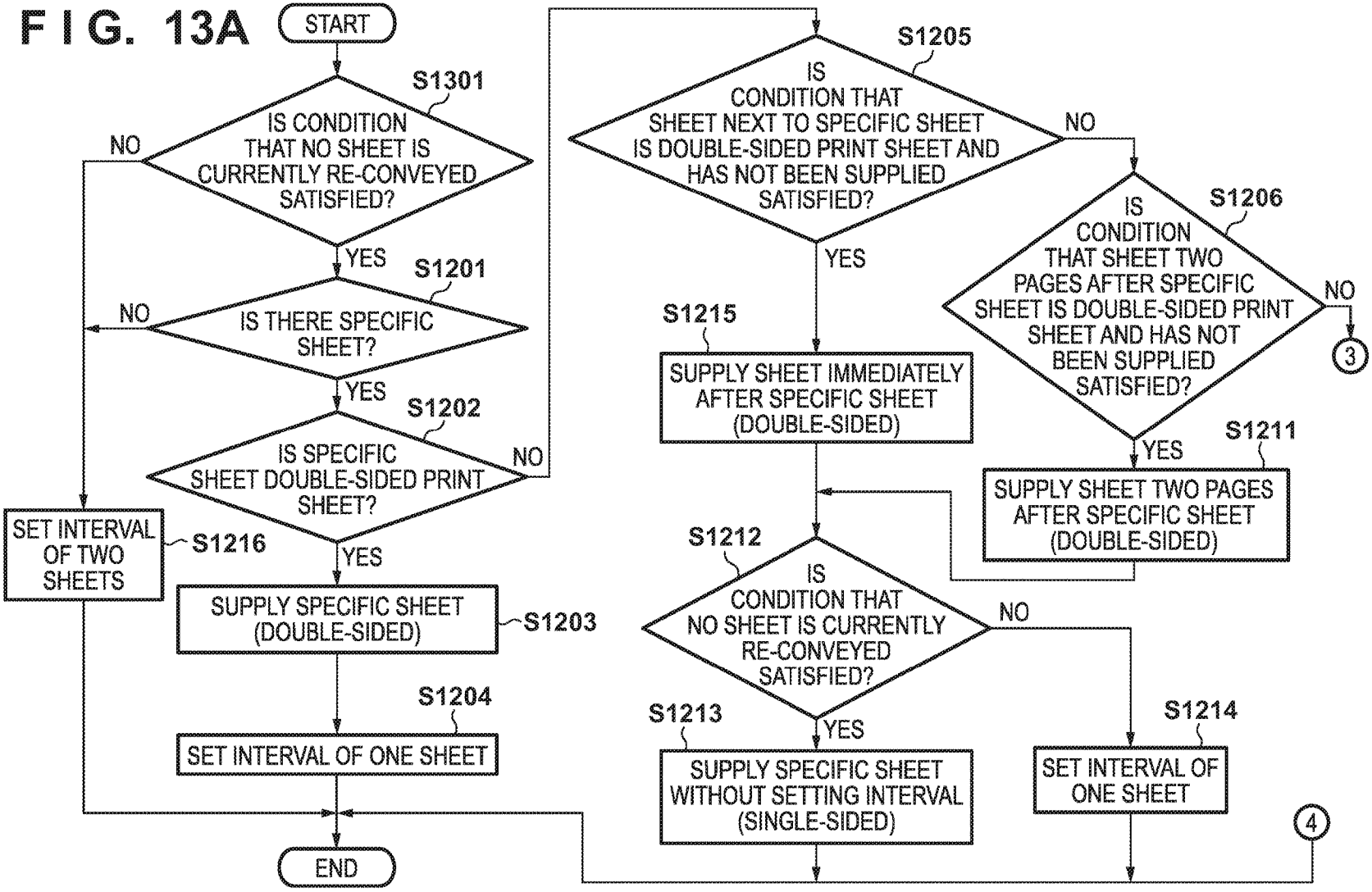
FIGS. 13A and 13B are flowcharts illustrating feed control processing.
Figure 13B:
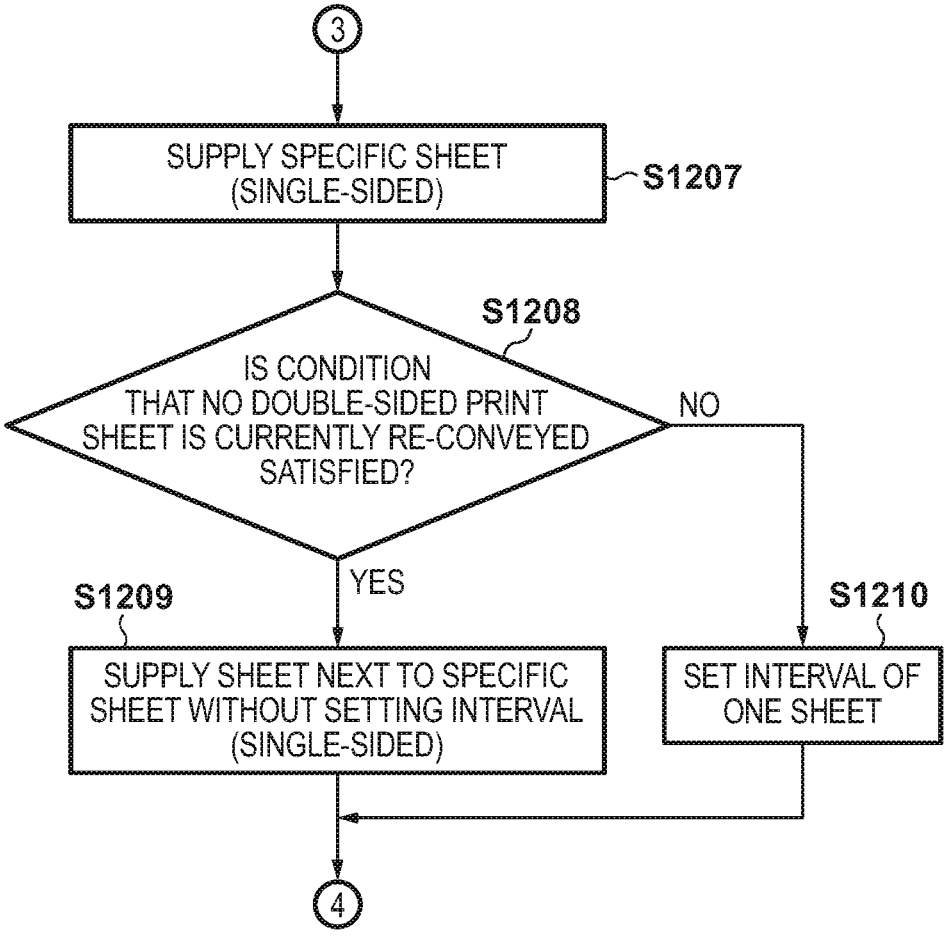

In FIGS. 12A and 12B, only when the specific sheet is a single-sided print sheet, it is determined in steps S1212 and S1208 whether the sheet is currently re-conveyed. As shown in FIGS. 13A and 13B, however, even if the specific sheet is a double-sided print sheet, it may be determined whether the sheet is currently re-conveyed. That is, instead of the processing shown in FIGS. 12A and 12B, processing shown in FIGS. 13A and 13B may be executed. Referring to FIGS. 13A and 13B, in step S1301 before the processing in step S1201, the CPU 201 determines whether a double-sided print sheet is currently re-conveyed at the position of the sensor 115. As described above, by executing, twice, at each timing, the processing of determining whether the sheet is currently re-conveyed, it is possible to reduce the possibility that the sheets collide with each other.

Figure 14:
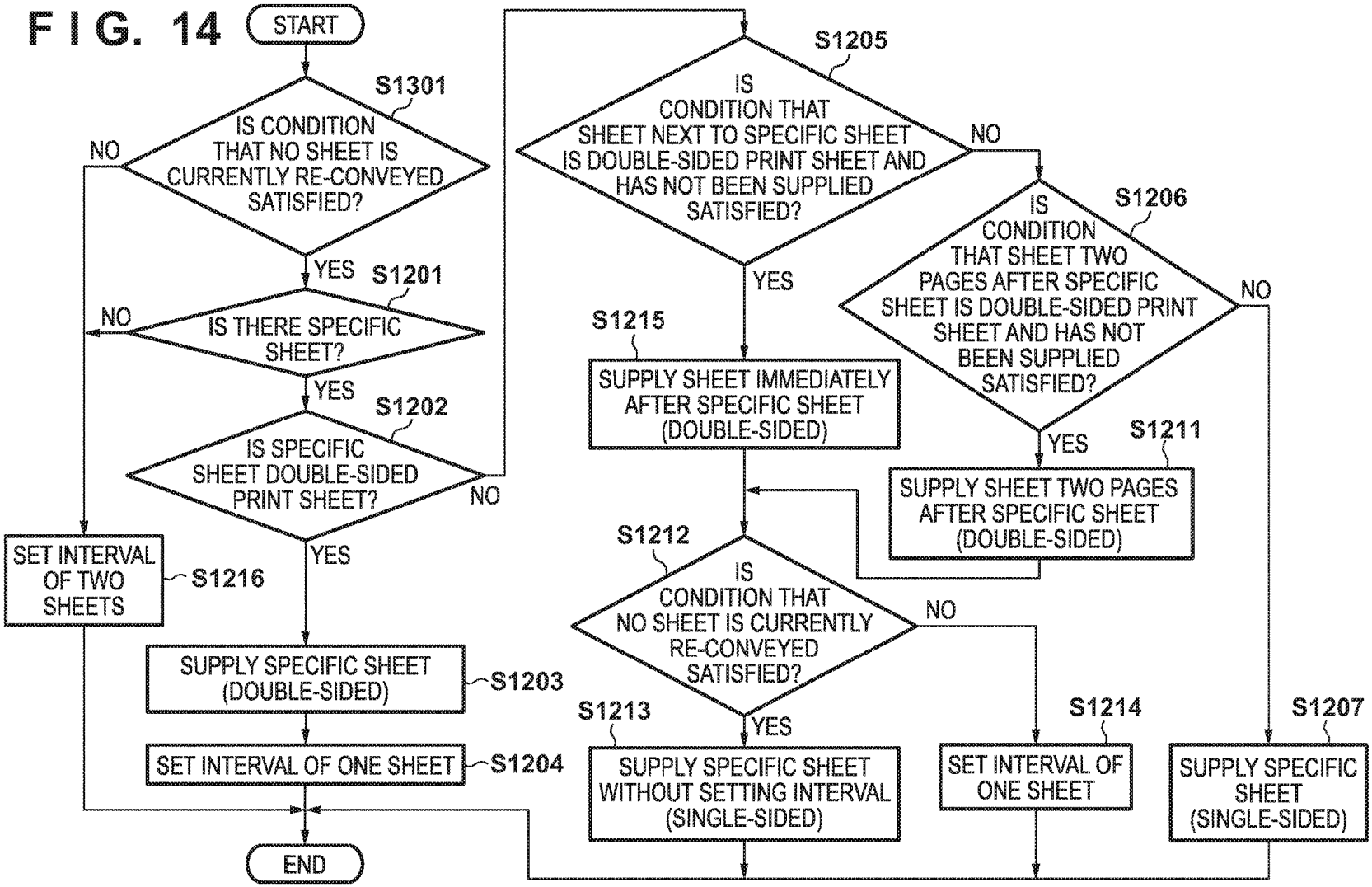
FIG. 14 is a flowchart illustrating feed control processing.

In FIGS. 12A and 12B, for example, the fifth sheet (single-sided print sheet) is supplied in step S1207, and an interval of one sheet is set with respect to the sixth sheet (single-sided print sheet) in step S1210. That is, in FIGS. 12A and 12B, whether to supply a sheet is controlled for each region of two sheets in the conveyance path. As shown in FIG. 14, however, whether to supply a sheet may be controlled for a region of one sheet or a region of two sheets in the conveyance path. This arrangement can simplify the processing. Results obtained by the processes of FIGS. 13A, 13B and 14 are the same as those of FIGS. 12A and 12B.

Note that the sensor 115 shown in FIG. 1 may be installed at any position between a sheet reversing unit 109 and the meeting point of paths of the "f" direction and the "a" direction, and the position is not limited to a position immediately before the meeting point. The timing of the feed processing shown in FIG. 11B, that is, the timing at which the processing of FIGS. 12A and 12B is performed, may be the timing at which the sheet passes through the point of the sensor 115.

As described above, in this embodiment, the print order is changed in accordance with whether there exists a double-sided print sheet within a predetermined number of sheets subsequent to a single-sided print sheet. As a result, it is possible to decrease the sheet interval between single-sided print sheets and the sheet interval at the start of a double-sided print sheet. In either a case in which only single-sided printing is executed or a case in which double-sided printing and single-sided printing are mixed and executed, it is possible to efficiently print while keeping the sheet conveyance speed constant.

Third Embodiment

Figure 19A:
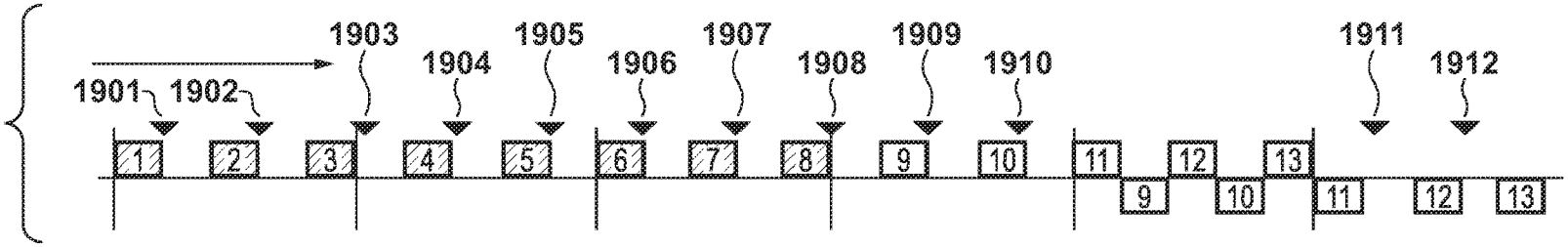
FIGS. 19A and 19B are views each showing a feed order when double-sided printing follows single-sided printing.
Figure 19B:
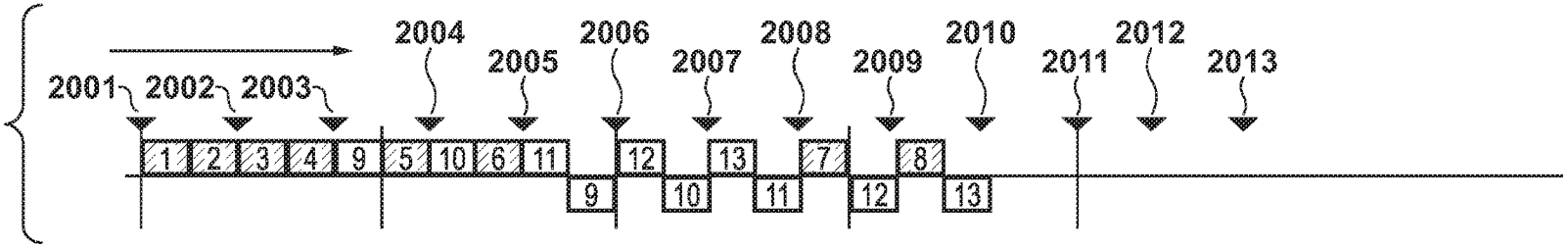

In the third embodiment, the difference from the first and second embodiments will be described below. FIG. 19A is a view showing a feed order when a double-sided print job follows a single-sided print job according to the conventional form. FIG. 19B is a view showing a feed order when double-sided printing follows single-sided printing in an image forming apparatus 100 according to this embodiment. Note that FIGS. 19A and 19B each show a feed order when a single-sided print job for executing single-sided printing on eight A4-size sheets and a double-sided print job for executing double-sided printing on five A4-size sheets are successively executed. In FIGS. 19A and 19B, a circulable sheet count is five for the A4size.

Referring to FIG. 19A, printing can be performed while keeping the sheet conveyance speed constant. Since printing is performed by setting a sheet interval in single-sided printing, however, spaces between sheets are large, and the printing is not efficient.

In addition, even when starting double-sided printing, a space between sheets is generated. For example, a space between sheets is set at each of timings 1901, 1902, 1903, 1904, 1905, 1906, 1907, 1908, 1909, 1910, 1911, and 1912 in FIG. 19A.

In this embodiment, as shown in FIG. 19B, a predetermined number of single-sided print sheets of a latter half are supplied after supplying subsequent double-sided print sheets. In this form, in either a case in which only a single-sided print job is executed, or a case in which a double-sided print job and a single-sided print job are successively processed, it is possible to feed sheets efficiently.

Figure 20A:
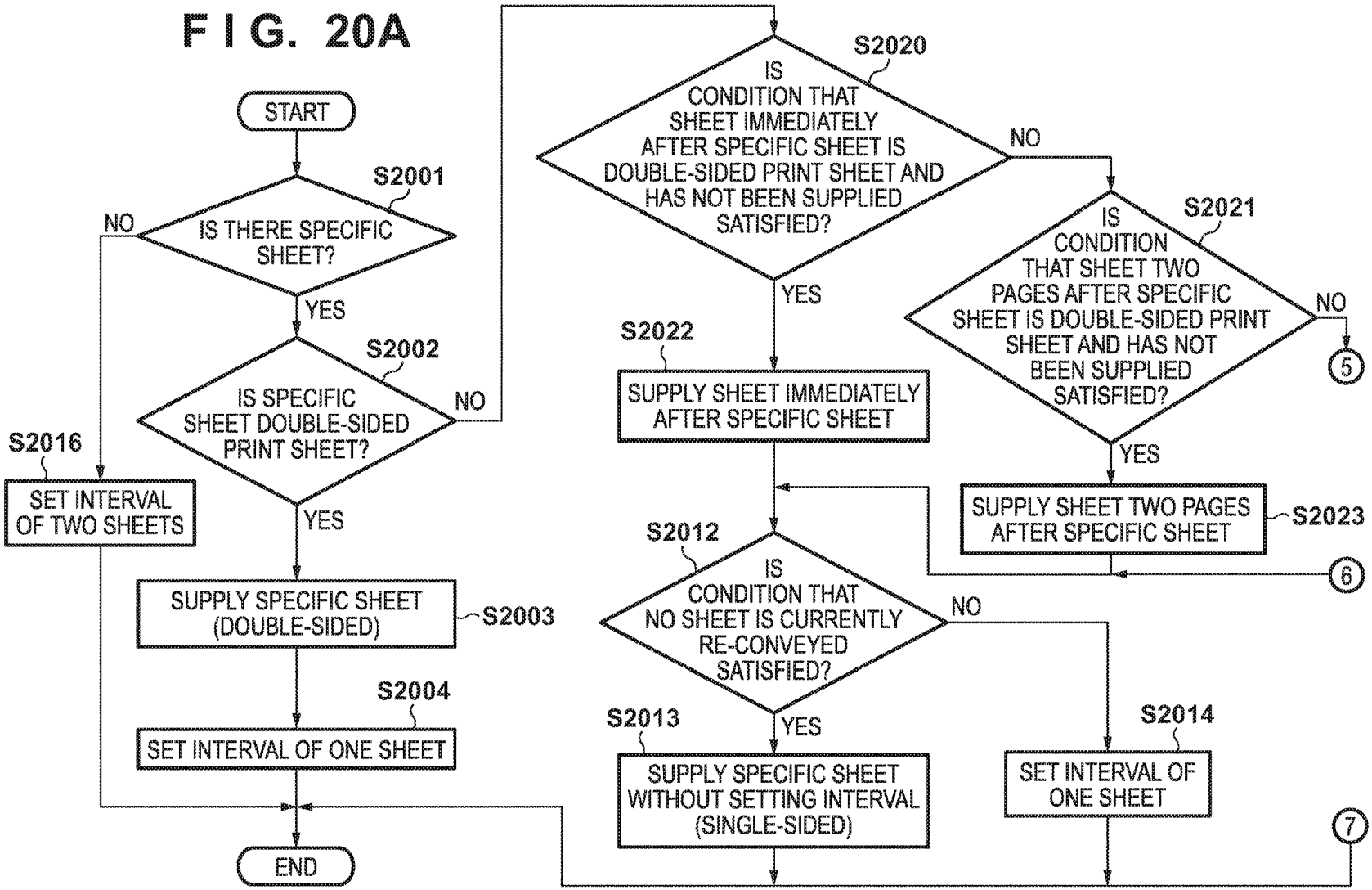
FIGS. 20A and 20B are flowcharts illustrating feed control processing.
Figure 20B:
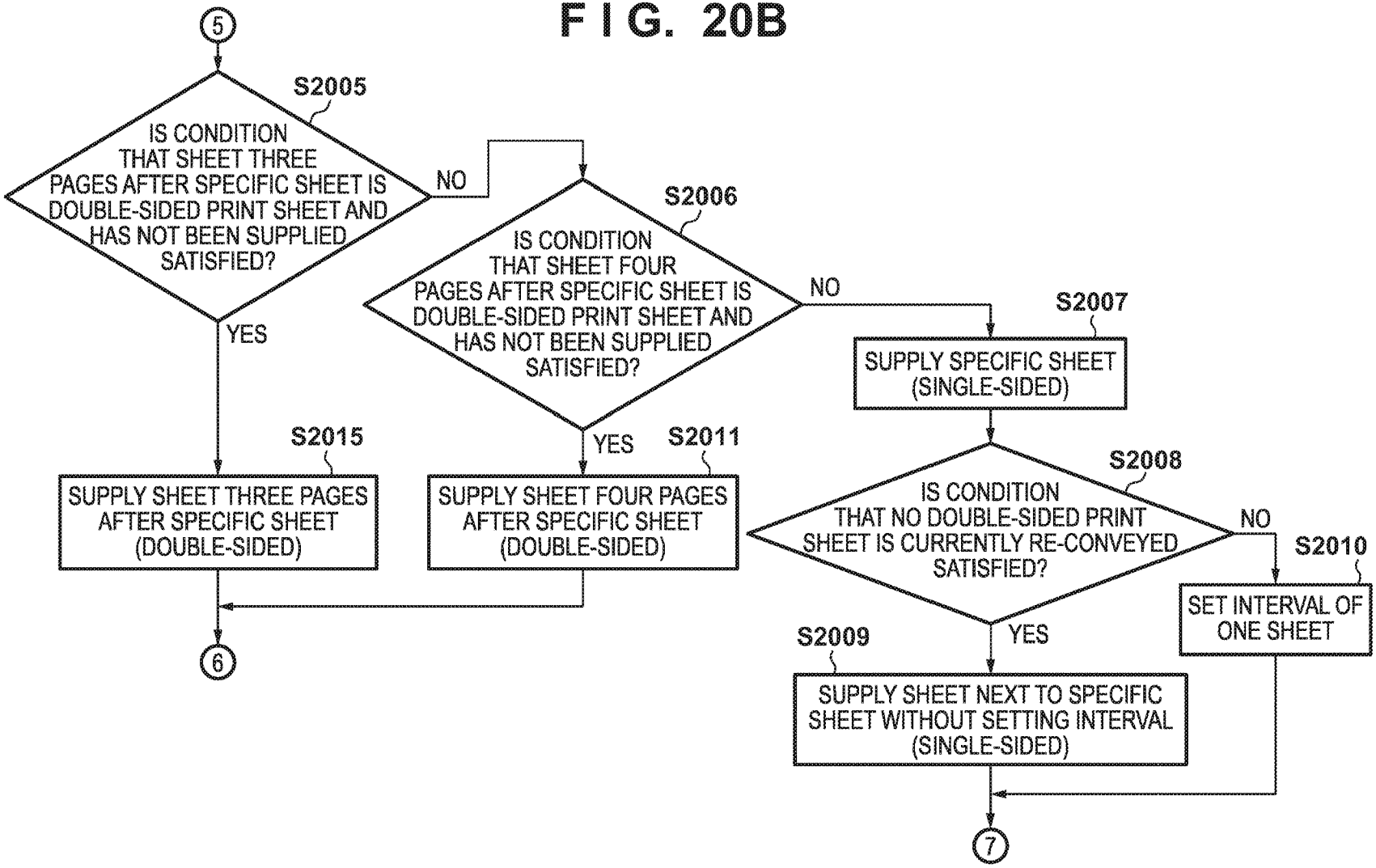

FIGS. 20A and 20B are flowcharts illustrating feed control processing executed by the image forming apparatus 100 according to this embodiment. Note that the processing of FIGS. 20A and 20B is implemented when, for example, a CPU 201 loads a program stored in a ROM 202 into a RAM 203 and executes the program. Alternatively, the processing of FIGS. 20A and 20B may be implemented by an engine control unit 208. The feed control processing of FIGS. 20A and 20B may be periodically executed for every predetermined time at the timing when a sheet is fed or executed at the timing when a print job is received from a host apparatus 211. In either of the methods, the result of FIG. 19B is obtained.

The feed control processing executed by the image forming apparatus 100 according to this embodiment will be described below with reference to FIGS. 20A and 20B. By executing the feed control processing once, at most, two sheets are supplied. Note that the CPU 201 completes an operation of supplying all supply target sheets by repeating the processing from START to END in FIGS. 20A and 20B. Every time the processing of FIGS. 20A and 20B is performed, the CPU 201 specifies a sheet with the smallest page number among supply target sheets that have not been supplied yet, and performs control (to be described later) with reference to the specified sheet (specific sheet). In this embodiment, assume that the processing shown in FIGS. 20A and 20B is executed every time a conveyance path is driven by a distance of two sheets. The CPU 201 stores the result of the feed control processing of FIGS. 20A and 20B in the RAM 203, and the engine control unit 208 performs print control on the sheet based on print data in accordance with the result of the feed control processing and a control command from the CPU 201.

In this embodiment, if the circulable sheet count is N, M (M=largest integer equal to or smaller than N/2) double-sided print sheets subsequent to single-sided printing are printed prior to M single-sided print sheets. That is, double-sided print sheets included in M×2 supply target sheets subsequent to the single-sided print sheet as the specific sheet are printed prior to the specific sheet. If the single-sided print sheet as the specific sheet is included in M sheets from the end of the successive single-sided print sheets, the single-sided print sheet as the specific sheet is supplied onto the conveyance path after supplying the double-sided print sheets. That is, at most, M single-sided print sheets are supplied onto the conveyance path after supplying the double-sided print sheets. For example, if the circulable sheet count is five, two double-sided print sheets subsequent to single-sided printing are printed prior to two single-sided print sheets. That is, double-sided print sheets included in four supply target sheets subsequent to the single-sided print sheet as the specific sheet are printed prior to the specific sheet. At most two single-sided print sheets are supplied onto the conveyance path after supplying the double-sided print sheets. Alternatively, if the circulable sheet count is seven, three double-sided print sheets subsequent to single-sided printing are printed prior to three single-sided print sheets. That is, at most six single-sided print sheets are supplied onto the conveyance path after supplying the double-sided print sheets. Furthermore, at most three single-sided print sheets are supplied onto the conveyance path after supplying the double sided print sheets.

FIGS. 23A to 23F, 24A to 24F, and 25 each show an example of information held in the RAM 203 if the processing of FIGS. 20A and 20B is executed at the timing when a print job is received from the host apparatus 211. Reference numerals 2301, 2302, and 2303 denote data fields. The data field 2301 indicates a feed ordinal number. The data field 2302 indicates the page number of the supply target sheet. The data field 2303 indicates whether the supply target sheet is a double-sided print sheet or a single-sided print sheet.

FIG. 26 shows information representing sheets supplied based on the print jobs received by the image forming apparatus 100 from the host apparatus 211. Note that FIG. 26 shows information representing the sheets supplied based on a single-sided print job for executing single-sided printing on eight A4-size sheets and a double-sided print job for executing double-sided printing on five A4-size sheets. Reference numerals 2601 and 2602 denote data fields. The data field 2601 indicates the page number of the supply target sheet. The data field 2602 indicates whether the supply target sheet is a double-sided print sheet or a single-sided print sheet.

The feed control processing when double-sided printing follows single-sided printing according to this embodiment will be described below with reference to FIGS. 19A to 21B, and 23A to 26. A case in which a sheet with page number 1 is specified as a specific sheet in the processing of FIGS. 20A and 20B executed first will be described.

At a timing 2001 of FIG. 19B, in step S2001, the CPU 201 determines whether there is a specific sheet. If it is determined that there is a specific sheet, the process advances to step S2002. Otherwise, the process advances to step S2016. In this example, since the sheet with page number 1 exists, the process advances to step S2002.

In step S2002, the CPU 201 determines whether the specific sheet is a double-sided print sheet. This determination processing is executed with reference to the data fields of FIG. 26. If it is determined that the specific sheet is a double-sided print sheet, the process advances to step S2003. Otherwise, the process advances to step S2020. In this example, since the sheet with page number 1 is not a double-sided print sheet but a single-sided print sheet, the process advances to step S2020.

In step S2020, the CPU 201 determines whether a condition that a sheet immediately after the current specific sheet is a double-sided print sheet and has not been supplied is satisfied. If it is determined that the condition is satisfied, the process advances to step S2022. Otherwise, the process advances to step S2021. In step S2022, the CPU 201 supplies the double-sided print sheet immediately after the current specific sheet, and advances to step S2012. In this example, since the sheet with page number 2 is not a double-sided print sheet but a single-sided print sheet, it is determined in step S2020 that the condition is not satisfied, and the process advances to step S2021.

In step S2021, the CPU 201 determines whether a condition that a sheet two pages after the current specific sheet is a double-sided print sheet and has not been supplied is satisfied. If it is determined that the condition is satisfied, the process advances to step S2023. Otherwise, the process advances to step S2005. In step S2023, the CPU 201 supplies the double-sided print sheet two pages after the current specific sheet, and advances to step S2012. In this example, since the sheet with page number 3 is not a double-sided print sheet but a single-sided print sheet, it is determined in step S2021 that the condition is not satisfied, and the process advances to step S2005.

In step S2005, the CPU 201 determines whether a condition that a sheet three pages after the current specific sheet is a double-sided print sheet and has not been supplied is satisfied. If it is determined that the condition is satisfied, the process advances to step S2015. Otherwise, the process advances to step S2006. In this example, since the sheet with page number 4 is not a double-sided print sheet but a single-sided print sheet, it is determined that the condition is not satisfied, and the process advances to step S2006.

In step S2006, the CPU 201 determines whether a condition that a sheet four pages after the current specific sheet is a double-sided print sheet and has not been supplied is satisfied. If it is determined that the condition is satisfied, the process advances to step S2011. Otherwise, the process advances to step S2007. In this example, since the sheet with page number 5 is not a double-sided print sheet but a single-sided print sheet, it is determined that the condition is not satisfied, and the process advances to step S2007.

In step S2007, the CPU 201 supplies the specific sheet onto the conveyance path. In this example, the CPU 201 supplies the sheet with page number 1, and advances to step S2008.

In step S2008, the CPU 201 determines whether a condition that no double-sided print sheet is currently re-conveyed at the position of a sensor 115 is satisfied. In this example, since no double-sided print sheet is currently re-conveyed at the position of the sensor 115, it is determined that the condition is satisfied, and the process advances to step S2009.

In step S2009, the CPU 201 supplies the sheet next to the current specific sheet without setting an interval. In this example, the CPU 201 supplies the sheet with page number 2 (to a region, on the conveyance path, within a predetermined distance from a position at which the sheet with page number 1 is supplied) without setting an interval with respect to the sheet with page number 1. Note that, in this embodiment, when sheets are conveyed without setting a sheet interval, the sheets may actually be conveyed at a predetermined small sheet interval.

At a timing 2002 of FIG. 19B, the CPU 201 handles the sheet with page number 3 as a specific sheet, and feeds the sheet through the same procedure as that at the timing 2001. That is, the CPU 201 supplies the sheet with page number 3 and the sheet with page number 4 without setting a sheet interval.

Next, at a timing 2003 of FIG. 19B, the CPU 201 executes the processing of FIGS. 20A and 20B by handling the sheet with page number 5 as a specific sheet. In step S2001, the CPU 201 determines whether there is a specific sheet. In this example, since the sheet with page number 5 exists, the process advances to step S2002.

In step S2002, the CPU 201 determines whether the specific sheet is a double-sided print sheet. In this example, since the sheet with page number 5 is not a double-sided print sheet but a single-sided print sheet, it is determined that the condition is not satisfied and the process advances to step S2020.

In step S2020, the CPU 201 determines whether the condition that a sheet immediately after the current specific sheet is a double-sided print sheet and has not been supplied is satisfied. If it is determined that the condition is satisfied, the process advances to step S2022. Otherwise, the process advances to step S2021. In step S2022, the CPU 201 supplies the double-sided print sheet immediately after the current specific sheet, and advances to step S2012. In this example, since the sheet with page number 6 is not a double-sided print sheet but a single-sided print sheet, it is determined in step S2020 that the condition is not satisfied and the process advances to step S2021.

In step S2021, the CPU 201 determines whether the condition that a sheet two pages after the current specific sheet is a double-sided print sheet and has not been supplied is satisfied. If it is determined that the condition is satisfied, the process advances to step S2023. Otherwise, the process advances to step S2005. In step S2023, the CPU 201 supplies the double-sided print sheet two pages after the current specific sheet, and advances to step S2012. In this example, since the sheet with page number 7 is not a double-sided print sheet but a single-sided print sheet, it is determined in step S2021 that the condition is not satisfied, and the process advances to step S2005.

In step S2005, the CPU 201 determines whether the condition that a sheet three pages after the current specific sheet is a double-sided print sheet and has not been supplied is satisfied. In this example, since the sheet with page number 8 is not a double-sided print sheet but a single-sided print sheet, it is determined that the condition is not satisfied, and the process advances to step S2006.

In step S2006, the CPU 201 determines whether the condition that a sheet four pages after the current specific sheet is a double-sided print sheet and has not been supplied is satisfied. In this example, since the sheet with page number 9 is a double-sided print sheet and has not been supplied, it is determined that the condition is satisfied, and the process advances to step S2011.

In step S2011, the CPU 201 supplies the double-sided print sheet four pages after the current specific sheet. In this example, the CPU 201 supplies the sheet with page number 9, and advances to step S2012.

In step S2012, the CPU 201 determines whether no double-sided print sheet is currently re-conveyed at the position of the sensor 115. If it is determined that no double-sided print sheet is re-conveyed at the position of the sensor 115, the process advances to step S2013. Otherwise, the process advances to step S2014. In this example, since no double-sided print sheet is re-conveyed at the position of the sensor 115, the process advances to step S2013. In step S2013, the CPU 201 supplies the specific sheet without setting an interval from a region where the previously supplied sheet is located. In this example, the CPU 201 supplies the sheet with page number 5 without setting a sheet interval with respect to the sheet with page number 9.

At a timing 2004 of FIG. 19B, the CPU 201 handles the sheet with page number 6 as a specific sheet, and feeds the sheet through the same procedure as that at the timing 2003. That is, the CPU 201 supplies the sheet with page number 10 before supplying the sheet with page number 6. The CPU 201 supplies the sheet with page number 6 without setting a sheet interval with respect to the sheet with page number 10.

At a timing 2005 of FIG. 19B, the CPU 201 handles the sheet with page number 7 as a specific sheet. In step S2001, the CPU 201 determines whether there is a specific sheet. In this example, since the sheet with page number 7 exists, the process advances to step S2002.

In step S2002, the CPU 201 determines whether the specific sheet is a double-sided print sheet. In this example, since the sheet with page number 7 is not a double-sided print sheet but a single-sided print sheet, the process advances to step S2020.

In step S2020, the CPU 201 determines whether the condition that a sheet immediately after the current specific sheet is a double-sided print sheet and has not been supplied is satisfied. If it is determined that the condition is satisfied, the process advances to step S2022. Otherwise, the process advances to step S2021. In step S2022, the CPU 201 supplies the double-sided print sheet immediately after the current specific sheet, and advances to step S2012. In this example, since the sheet with page number 8 is not a double-sided print sheet but a single-sided print sheet, it is determined in step S2020 that the condition is not satisfied, and the process advances to step S2021.

In step S2021, the CPU 201 determines whether the condition that a sheet two pages after the current specific sheet is a double-sided print sheet and has not been supplied is satisfied. If it is determined that the condition is satisfied, the process advances to step S2023. Otherwise, the process advances to step S2005. In step S2023, the CPU 201 supplies the double-sided print sheet two pages after the current specific sheet, and advances to step S2012. In this example, since the sheet with page number 9 is a double-sided print sheet but has already been supplied, it is determined that the condition is not satisfied, and the process advances to step S2005.

In step S2005, the CPU 201 determines whether the condition that a sheet three pages after the current specific sheet is a double-sided print sheet and has not been supplied is satisfied. In this example, since the sheet with page number 10 is a double-sided print sheet but has already been supplied, it is determined that the condition is not satisfied, and the process advances to step S2006.

In step S2006, the CPU 201 determines whether the condition that a sheet four pages after the current specific sheet is a double-sided print sheet and has not been supplied is satisfied. In this example, since the sheet with page number 11 is a double-sided print sheet and has not been supplied, it is determined that the condition is satisfied, and the process advances to step S2011.

In step S2011, the CPU 201 supplies the sheet four pages after the current specific sheet. In this example, the CPU 201 supplies the sheet with page number 11, and advances to step S2012.

In step S2012, the CPU 201 determines whether the condition that no double-sided print sheet is currently re-conveyed at the position of the sensor 115 is satisfied. If it is determined that the condition is satisfied, the process advances to step S2013. Otherwise, the process advances to step S2014. In this example, since the double-sided print sheet is currently re-conveyed, the CPU 201 advances to step S2014.

In step S2014, the CPU 201 controls not to supply a sheet to a region of one sheet from a region where the previously (step S2015 or 52011) supplied sheet is located. Then, the CPU 201 changes the specific sheet, and repeats the processing of FIGS. 20A and 20B. That is, the CPU 201 does not supply the specific sheet (in this example, the sheet with page number 7) at this time.

At a timing 2006 of FIG. 19B, the CPU 201 handles the sheet with page number 8 as a specific sheet, and feeds the sheet through the same procedure as that at the timing 2005. That is, the CPU 201 supplies not the sheet with page number 8 but the sheet with page number 12.

At a timing 2007 of FIG. 19B, the CPU 201 handles the sheet with page number 13 as a specific sheet. In step S2001, the CPU 201 determines whether there is a specific sheet. In this example, since the sheet with page number 13 exists, the process advances to step S2002.

In step S2002, the CPU 201 determines whether the specific sheet is a double-sided print sheet. In this example, since the sheet with page number 13 is a double-sided print sheet, the process advances to step S2003.

In step S2003, the CPU 201 supplies the specific sheet. In this example, the CPU 201 supplies the sheet with page number 13, and advances to step S2004.

In step S2004, the CPU 201 controls not to supply a sheet to a region of one sheet from a region where the previously (step S2003) supplied sheet is located.

At this time, supply of the sheet with the last page number is complete but there is a supply target sheet that has not been supplied. Therefore, the CPU 201 handles, as a specific sheet, the supply target sheet that has not been supplied, and executes the processing of FIGS. 20A and 20B. At a timing 2008 of FIG. 19B, the CPU 201 handles the sheet with page number 7 as a specific sheet. In step S2001, the CPU 201 determines whether there is a specific sheet. In this example, since the sheet with page number 7 exists, the process advances to step S2002.

In step S2002, the CPU 201 determines whether the specific sheet is a double-sided print sheet. In this example, since the sheet with page number 7 is not a double-sided print sheet but a single-sided print sheet, the process advances to step S2020.

In step S2020, the CPU 201 determines whether the condition that a sheet immediately after the current specific sheet is a double-sided print sheet and has not been supplied is satisfied. If it is determined that the condition is satisfied, the process advances to step S2022. Otherwise, the process advances to step S2021. In step S2022, the CPU 201 supplies the double-sided print sheet immediately after the current specific sheet, and advances to step S2012. In this example, since the sheet with page number 8 is not a double-sided print sheet but a single-sided print sheet, it is determined in step S2020 that the condition is not satisfied, and the process advances to step S2021.

In step S2021, the CPU 201 determines whether the condition that a sheet two pages after the current specific sheet is a double-sided print sheet and has not been supplied is satisfied. If it is determined that the condition is satisfied, the process advances to step S2023. Otherwise, the process advances to step S2005. In step S2023, the CPU 201 supplies the double-sided print sheet two pages after the current specific sheet, and advances to step S2012. In this example, since the sheet with page number 9 is a double-sided print sheet but has already been supplied, it is determined that the condition is not satisfied, and the process advances to step S2005.

In step S2005, the CPU 201 determines whether the condition that a sheet three pages after the current specific sheet is a double-sided print sheet and has not been supplied is satisfied. In this example, since the sheet with page number 10 is a double-sided print sheet but has already been supplied, it is determined that the condition is not satisfied, and the process advances to step S2006.

In step S2006, the CPU 201 determines whether the condition that a sheet four pages after the current specific sheet is a double-sided print sheet and has not been supplied is satisfied. In this example, since the sheet with page number 11 is a double-sided print sheet but has already been supplied, it is determined that the condition is not satisfied, and the process advances to step S2007.

In step S2007, the CPU 201 supplies the specific sheet. In this example, the CPU 201 supplies the sheet with page number 7, and advances to step S2008.

In step S2008, the CPU 201 determines whether the condition that no double-sided print sheet is currently re-conveyed at the position of the sensor 115 is satisfied. If it is determined that the condition is satisfied, the process advances to step S2009. Otherwise, the process advances to step S2010. In this example, since the double-sided print sheet is currently re-conveyed at this time, the CPU 201 advances to step S2010.

In step S2010, the CPU 201 controls not to supply a sheet to a region of one sheet from a region where the previously (step S2007) supplied sheet is located.

At a timing 2009 of FIG. 19B, the CPU 201 handles the sheet with page number 8 as a specific sheet, and feeds the sheet through the same procedure as that at the timing 2003. That is, after supplying the sheet with page number 8, the CPU 201 controls not to supply a sheet to a region of one sheet from a position at which the sheet with page number 8 is supplied.

This embodiment provides an example in which the processing is periodically executed for every predetermined time at the timing when a sheet is fed. When the processing of FIGS. 20A and 20B is executed at each of the timings 2001 to 2013 of FIG. 19B, the information held in the RAM 203 changes, as shown in FIGS. 23A to 25.

Figure 21A:
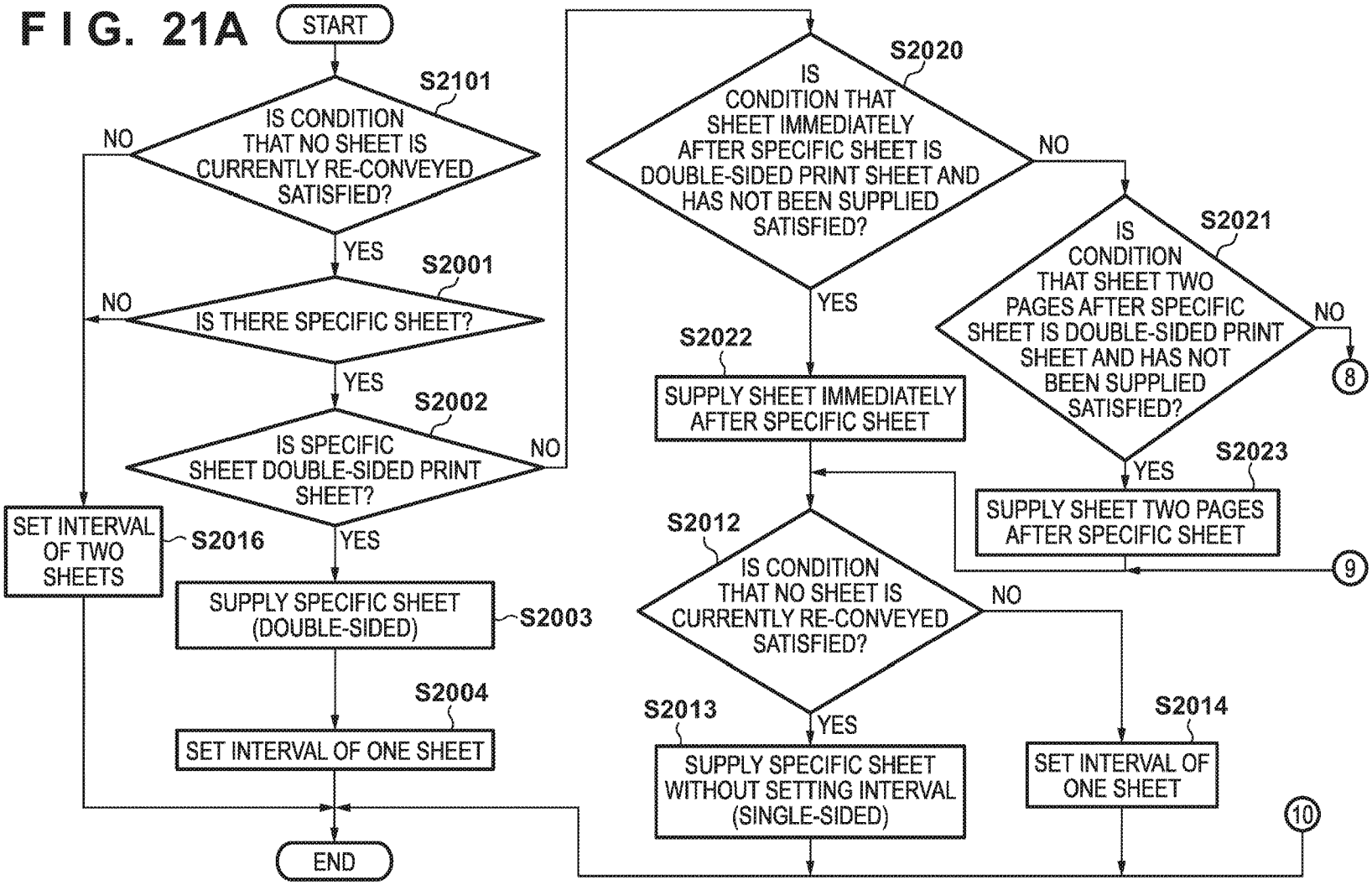
FIGS. 21A and 21B are flowcharts illustrating feed control processing.
Figure 21B:
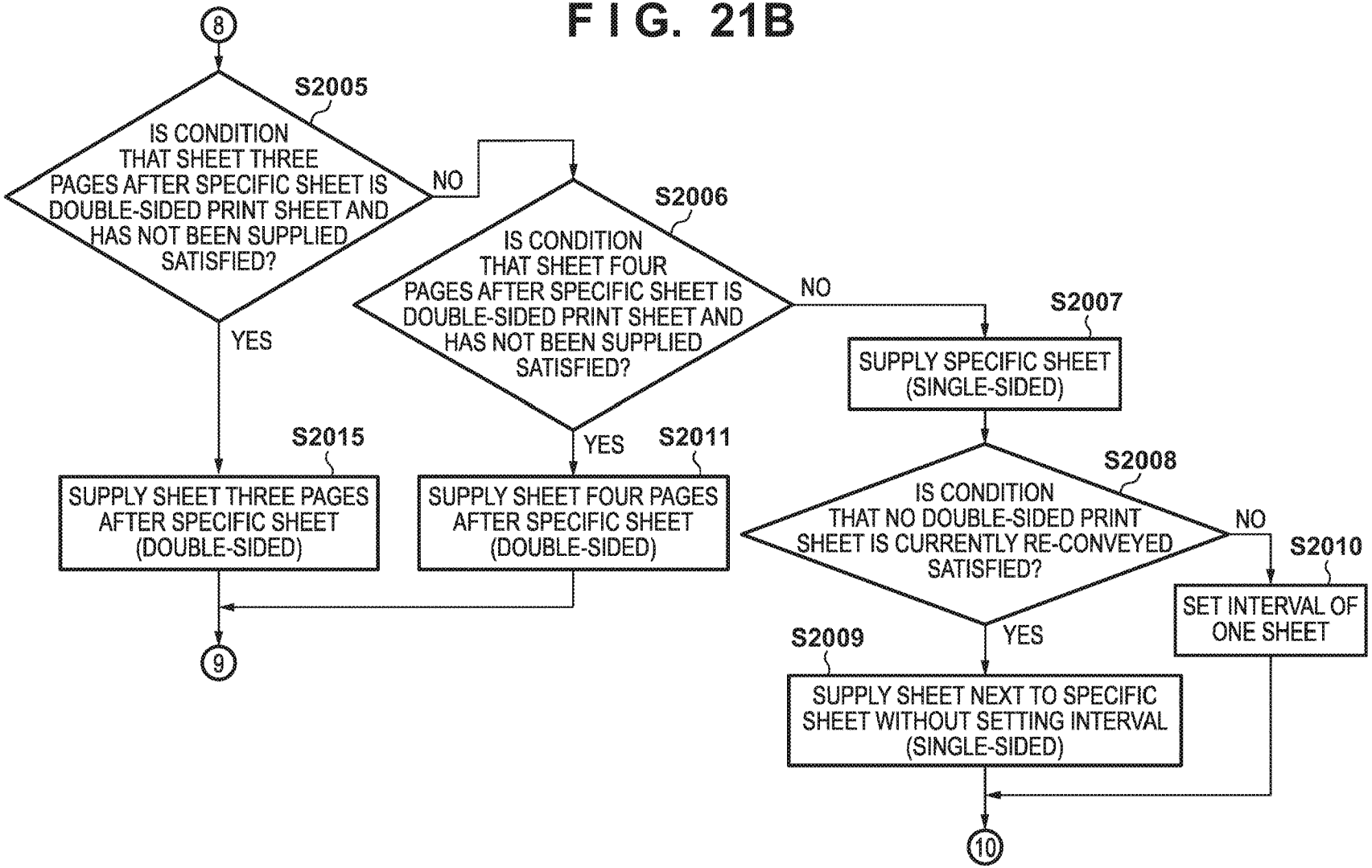

In FIGS. 20A and 20B, only when the specific sheet is a single-sided print sheet, it is determined in steps 52012 and 52008 whether the double-sided print sheet is currently re-conveyed. As shown in FIGS. 21A and 21B, however, even if the specific sheet is a double-sided print sheet, it may be determined whether the double-sided print sheet is currently re-conveyed. That is, instead of the processing shown in FIGS. 20A and 20B, processing shown in FIGS. 21A and 21B may be executed. Referring to FIGS. 21A and 21B, in step S2101 before the processing in step S2001, the CPU 201 determines whether the double-sided print sheet is currently re-conveyed at the position of the sensor 115. As described above, by executing, twice, at each timing, the processing of determining whether the sheet is currently re-conveyed, it is possible to reduce the possibility that the sheets collide with each other.

Figure 22A:
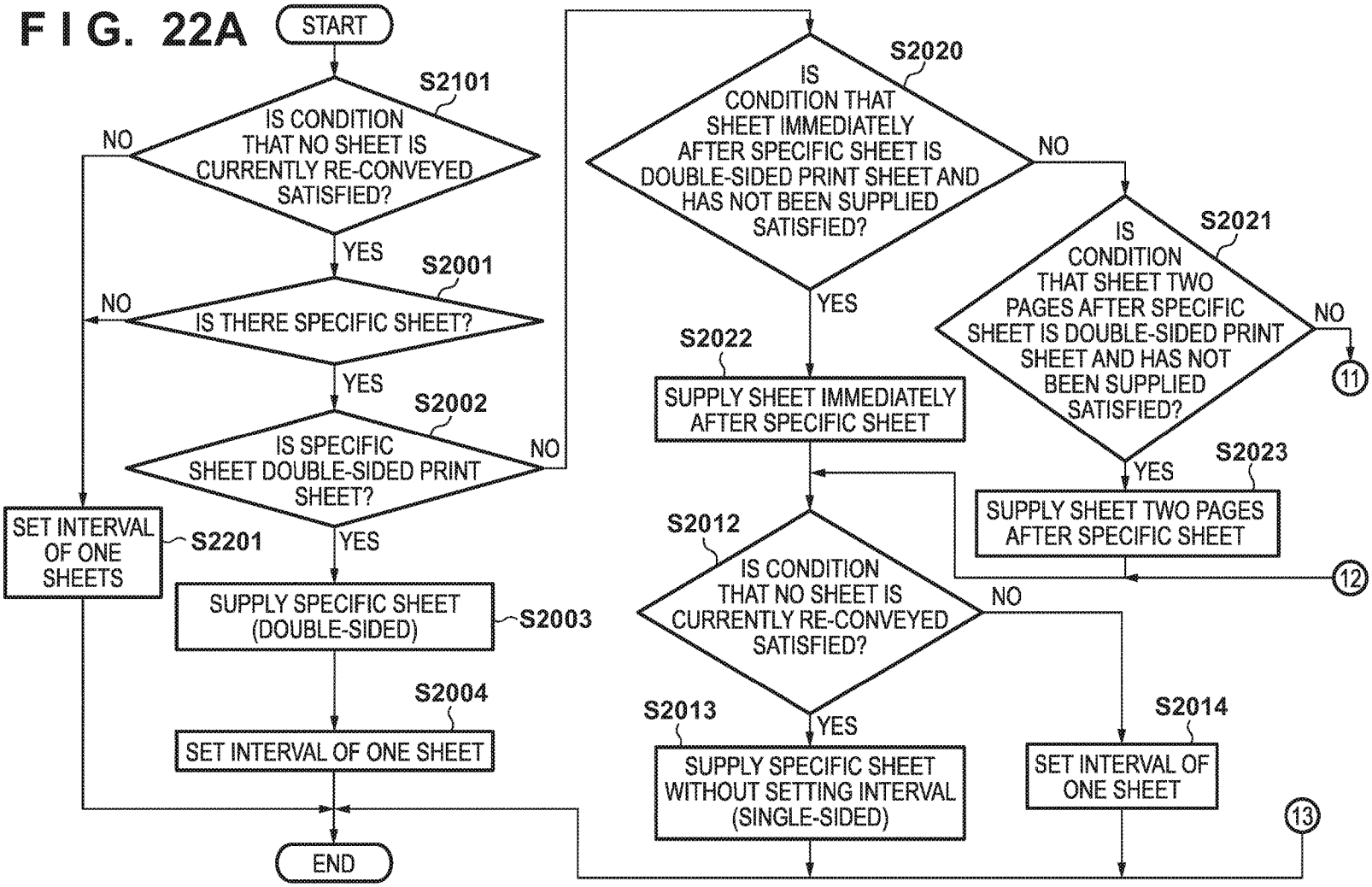
FIGS. 22A and 22B are flowcharts illustrating feed control processing.
Figure 22B:
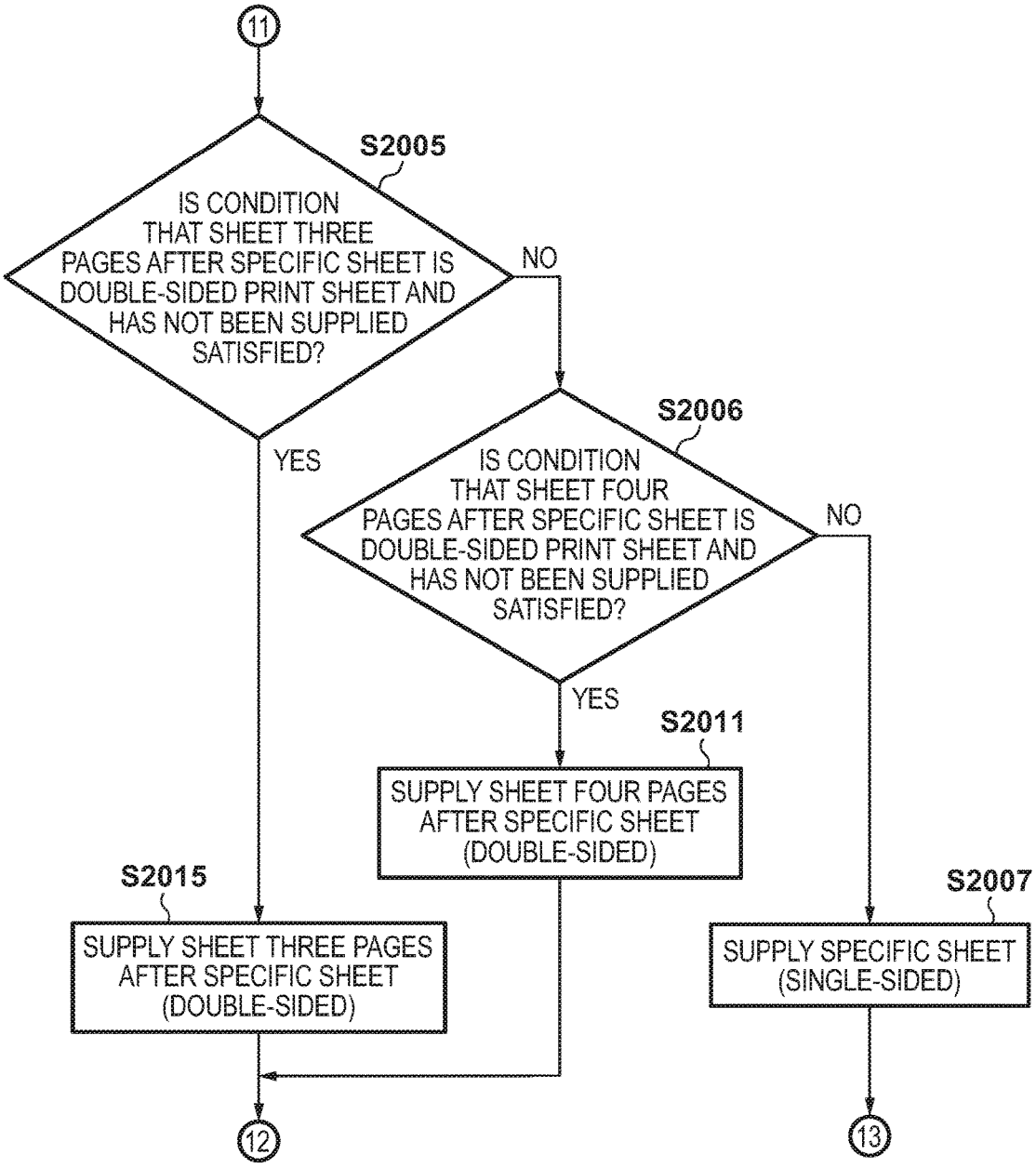
Figure 27:
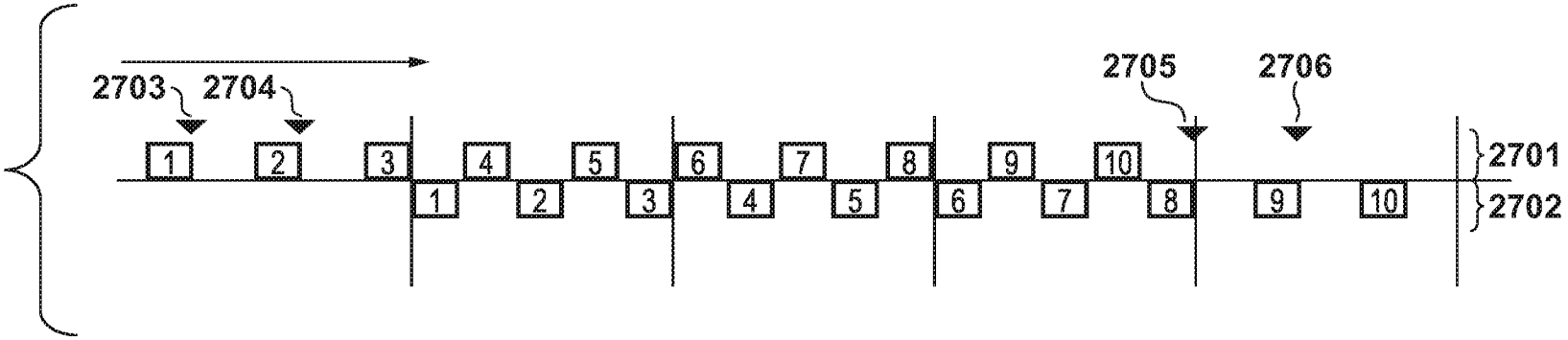
FIG. 27 is a view for explaining a feed interval.

In FIGS. 20A and 20B, for example, after the third sheet (single-sided print sheet) is supplied in step S2007, an interval of one sheet is set before supplying the fourth sheet (single-sided print sheet) in step S2010. That is, in FIGS. 20A and 20B, whether to supply a sheet is controlled for each region of two sheets in the conveyance path. As shown in FIGS. 21A and 21B, however, whether to supply a sheet may be controlled for a region of one sheet or a region of two sheets in the conveyance path. This arrangement can simplify the processing. Results obtained by processes of FIGS. 21, 22A and 22B are the same as those of FIGS. 20A and 20B.

Note that the sensor 115 shown in FIG. 1 may be installed at any position between a sheet reversing unit 109 and the meeting point of paths the "f" direction and the "a" direction, and the position is not limited to a position immediately before the meeting point. The timing of the feed processing shown in FIG. 19B, that is, the timing at which the processing of FIGS. 20A and 20B is performed may be the timing at which the sheet passes through the point of the sensor 115.

As described above, in this embodiment, a predetermined number of single-sided print sheets of a latter half are printed after printing subsequent double-sided print sheets. As a result, as shown in FIG. 19B, it is possible to decrease the sheet intervals on the conveyance path. In either a case in which only single-sided printing is executed or a case in which double-sided printing and single-sided printing are mixed and executed, it is possible to efficiently print while keeping the sheet conveyance speed constant.

[Other Embodiments]

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A conveyance apparatus comprising:

(A) a conveyance unit configured to convey, using a conveyance path, a print medium to an image forming component configured to form an image on the print medium;

(B) a supply unit configured to supply the print medium to the conveyance path;

(C) a re-conveyance unit configured to re-convey, to the image forming component, the print medium, on which the image is formed by the image forming component, to perform double-sided printing; and (D) a control unit configured:

(a) to control, if a first print medium among supply target print media supplied by the supply unit is a print medium to be used for single-sided printing, and the print medium re-conveyed by the re-conveyance unit is located within a predetermined distance from a region where the first print medium is located on the conveyance path, the supply unit so that an interval between the region where the first print medium is located on the conveyance path and a region where a second print medium supplied to the conveyance path next to the first print medium is located on the conveyance path becomes a first interval; and (b) to control, if the first print medium is a print medium to be used for single-sided printing and the print medium re-conveyed by the re-conveyance unit is not located within the predetermined distance from the region where the first print medium is located on the conveyance path, the supply unit so that the interval between the region where the first print medium is located on the conveyance path and the region where the second print medium is located on the conveyance path becomes a second interval shorter than the first interval.

2. The apparatus according to claim 1, wherein, if the first print medium is a print medium to be used for double-sided printing, the control unit controls the supply unit so that an interval between a position of the first print medium on the conveyance path and a position of the second print medium on the conveyance path becomes the first interval.

3. The apparatus according to claim 1, wherein, if the first print medium is a print medium to be used for single-sided printing, and a third print medium that is a predetermined number of pages after a page number of the first print medium is a print medium to be used for double-sided printing, the control unit controls the supply unit to supply the third print medium prior to the first print medium.

4. The apparatus according to claim 3, wherein the control unit controls the supply unit so that an interval between the region where the first print medium is located on the conveyance path and a region where the third print medium is located on the conveyance path becomes the second interval.

5. The apparatus according to claim 3, wherein, when the predetermined number of pages is M and the number of print media which can be arranged on the conveyance path is N, M=largest integer not greater than N/2.

6. The apparatus according to claim 3, wherein, after a plurality of print media to be used for double-sided printing are supplied subsequently to the third print medium, the control unit controls the supply unit to supply the first print medium to the conveyance path.

7. The apparatus according to claim 6, wherein, after the plurality of print media to be used for double-sided printing are supplied subsequently to the print medium to be used for single-sided printing, the control unit controls the supply unit to supply a number P of print media to be used for single-sided printing to the conveyance path, and, when the number of print media that can be arranged on the conveyance path is N, P=(larger integer not greater than N/2).

8. The apparatus according to claim 6, wherein, when the predetermined number is M and the number of print media that can be arranged on the conveyance path is N, M=(larger integer not greater than N/2)×2.

9. The apparatus according to claim 1, wherein the first interval is a length corresponding to a size of one print medium.

10. The apparatus according to claim 1, further comprising:

a reception unit configured to receive a job for forming the image on the print medium by the image forming component, wherein, if the reception unit receives the job, the supply unit supplies the print medium to the conveyance path.

11. A control method for controlling a conveyance apparatus, the control method comprising:

conveying, using a conveyance path, a print medium to an image forming component configured to form an image on the print medium;

supplying the print medium to the conveyance path;

re-conveying, to the image forming component, the print medium, on which the image is formed by the image forming component, to perform double-sided printing; and controlling, if a first print medium among supply target print media is a print medium to be used for single-sided printing and the re-conveyed print medium is located within a predetermined distance from a region where the first print medium is located on the conveyance path, supply of the print medium to the conveyance path so that an interval between the region where the first print medium is located on the conveyance path and a region where a second print medium supplied to the conveyance path next to the first print medium is located on the conveyance path becomes a first interval, and controlling, if the first print medium is a print medium to be used for single-sided printing and the re-conveyed print medium is not located within the predetermined distance from the region where the first print medium is located on the conveyance path, supply of the print medium to the conveyance path so that the interval between the region where the first print medium is located on the conveyance path and the region where the second print medium is located on the conveyance path becomes a second interval shorter than the first interval.

12. A non-transitory computer-readable medium storing a program for causing a conveyance apparatus to execute:

conveying, using a conveyance path, a print medium to an image forming component configured to form an image on the print medium;

supplying the print medium to the conveyance path;

re-conveying, to the image forming component, the print medium, on which the image is formed by the image forming component, to perform double-sided printing; and controlling, if a first print medium among supply target print media is a print medium to be used for single-sided printing and the re-conveyed print medium is located within a predetermined distance from a region where the first print medium is located on the conveyance path, supply of the print medium to the conveyance path so that an interval between the region where the first print medium is located on the conveyance path and a region where a second print medium supplied to the conveyance path next to the first print medium is located on the conveyance path becomes a first interval, and controlling, if the first print medium is a print medium to be used for single-sided printing and the re-conveyed print medium is not located within the predetermined distance from the region where the first print medium is located on the conveyance path, supply of the print medium to the conveyance path so that the interval between the region where the first print medium is located on the conveyance path and the region where the second print medium is located on the conveyance path becomes a second interval shorter than the first interval.

* * * * *